US009462891B2

(12) United States Patent
Kikuchi et al.

(10) Patent No.: US 9,462,891 B2
(45) Date of Patent: Oct. 11, 2016

(54) OFFICE CHAIR

(71) Applicant: TAKANO CO., LTD., Nagano (JP)

(72) Inventors: Ken Kikuchi, Nagano (JP); Isao Okamoto, Nagano (JP); Yousuke Shirotori, Nagano (JP)

(73) Assignee: Takano Co., Ltd., Nagano (JP)

( * ) Notice: Subject to any disclaimer, the term of this patent is extended or adjusted under 35 U.S.C. 154(b) by 119 days.

(21) Appl. No.: 14/002,077

(22) PCT Filed: Mar. 21, 2013

(86) PCT No.: PCT/JP2013/001922
§ 371 (c)(1),
(2) Date: Aug. 28, 2013

(87) PCT Pub. No.: WO2014/147663
PCT Pub. Date: Sep. 25, 2014

(65) Prior Publication Data

US 2015/0173514 A1 Jun. 25, 2015

(51) Int. Cl.

| | |
|---|---|
| ***A47C 7/02*** | (2006.01) |
| ***A47C 5/02*** | (2006.01) |
| ***A47C 7/28*** | (2006.01) |
| ***A47C 7/32*** | (2006.01) |
| ***A47C 31/02*** | (2006.01) |
| ***A47C 3/00*** | (2006.01) |
| ***A47C 5/00*** | (2006.01) |
| ***D03D 1/00*** | (2006.01) |
| ***D03D 9/00*** | (2006.01) |
| ***D03D 15/08*** | (2006.01) |

(52) U.S. Cl.
CPC . *A47C 5/02* (2013.01); *A47C 3/00* (2013.01); *A47C 5/00* (2013.01); *A47C 7/282* (2013.01); *A47C 7/32* (2013.01); *A47C 31/02* (2013.01); *D03D 1/00* (2013.01); *D03D 9/00* (2013.01); *D03D 15/08* (2013.01); *D10B 2401/04* (2013.01); *D10B 2505/08* (2013.01)

(58) Field of Classification Search
CPC .... A47C 31/02; A47C 31/282; A47C 31/32; A47C 5/02; A47C 5/00; A47C 3/00; D03D 9/02; D10B 2401/04; D10B 2505/08
USPC ..... 297/452.56
See application file for complete search history.

(56) References Cited

U.S. PATENT DOCUMENTS

| | | | | |
|---|---|---|---|---|
| 6,254,190 | B1 * | 7/2001 | Gregory | 297/452.1 |
| 7,851,390 | B2 * | 12/2010 | Salzmann et al. | 442/303 |
| 2010/0237679 | A1 * | 9/2010 | Tsukiji et al. | 297/452.18 |

FOREIGN PATENT DOCUMENTS

| | | |
|---|---|---|
| JP | 2001-008775 | 1/2001 |
| JP | 2001-078852 | 3/2001 |

(Continued)

*Primary Examiner* — David R Dunn
*Assistant Examiner* — Alexander Harrison
(74) *Attorney, Agent, or Firm* — Notaro, Michalos & Zaccaria P.C.

(57) ABSTRACT

A chair has a body support structure with a membrane that can be stretched in an intended three-dimensional shape. The structure includes a frame member in a three-dimensional shape and forming a three-dimensional body support face expanding in three axes (y-axis direction), (x-axis direction), and (z-axis direction) orthogonal to each other and a membrane with peripheral edge portion fixed to the frame member under no tension or tension lower than tension required of the body support face, which has different heat shrinkage ratios in two directions, and to which the tension required of the body support face is imparted by heat shrinkage by heating after the fixing and a difference in tension generated in the heat shrinkage of the membrane forms the three-dimensional body support face.

18 Claims, 17 Drawing Sheets

(56) References Cited

FOREIGN PATENT DOCUMENTS

| | | |
|---|---|---|
| JP | 2001-333839 | 12/2001 |
| JP | 2007-117564 | 5/2007 |
| JP | 2009-112360 | 5/2009 |
| WO | WO 2005025379 | 3/2005 |

* cited by examiner

OFFICE CHAIR

TECHNICAL FIELD

The present invention relates to a chair including a body support structure having a membrane forming a body support face. More specifically, the invention relates to a chair including a body support structure which is formed by a frame member and a membrane having a peripheral edge portion supported by the frame member and which functions as a seat, a backrest, or the like.

BACKGROUND ART

Conventionally, there are chairs each including a body support structure which is formed by a frame member and a membrane having a peripheral edge portion supported by the frame member and which functions as a seat, a backrest, or the like. In this chair, the membrane and the frame member retaining the entire or part of the peripheral edge portion of the membrane form the body support structure so that the membrane forms a body support face. For example, with regard to the seat, a flat seating face is formed by fixing a membrane having a heat shrinkable property to a frame member under no tension or tension lower than tension required of the body support structure and pressing heated aluminum plates against opposite faces of the membrane to heat the membrane and shrink the membrane in front-back and left-right directions to impart the tension for exerting elasticity required of the body support structure (see Patent Literature 1).

CITATION LIST

Patent Literature

Patent Literature 1: Japanese Patent Application Laid-Open Publication No. 2001-78852

SUMMARY OF INVENTION

Technical Problem

However, if the body support face such as the seating face and the backrest face needs to be not a simple flat face but a three-dimensional curved face, it is difficult to stretch the membrane to form an intended curved face by merely forming the frame-shaped frame member into a curved shape and imparting the tension so as to substantially uniformly pulling the membrane in the front-back/vertical and left-right directions by heat shrinkage as in the case of the prior-art membrane. For example, near a front edge portion of the seat, it is desired that a curved face along a shape of the frame member curved to hang downward is formed near a front edge portion of the membrane. However, while the curved faces are formed near sides of the frame member, a radius of curvature gradually increases as compared with those of peripheries as the membrane extends away from the sides to form a shape close to a gentle slope and then form the most recessed flat face which is warped as a whole near a center in the left-right direction.

It is an object of the invention to provide a chair having a body support structure in which a membrane can be stretched in an intended three-dimensional shape.

Solution to Problem

In order to achieve the object, in a chair including a body support structure having a membrane forming a body support face according to the present invention, the body support structure includes a frame member in a three-dimensional shape and forming the three-dimensional body support face expanding in directions of three axes, that is, a front-back/vertical direction, a left-right direction, and a depth direction orthogonal to each other and a membrane which has a peripheral edge portion fixed to the frame member under no tension or tension lower than tension required of the body support face, which has different heat shrinkage ratios in the front-back/vertical direction and the left-right direction, and to which the tension required of the body support face is imparted by heat shrinkage by heating after the fixing and a difference intension generated in the heat shrinkage of the membrane forms the three-dimensional body support face along the shape of the frame member.

Here, it is preferred that the membrane has the higher heat shrinkage ratio in the direction with a smaller amount of displacement in the depth direction out of the front-back/vertical direction and the left-right direction than in the direction with a larger amount of displacement in the depth direction and the entire membrane shrinks along the three-dimensional shape of the frame member due to the difference in the tension generated in the heat shrinkage between the front-back/vertical direction and the left-right direction.

Preferably, the membrane is a textile woven by using heat shrinkable warp and weft and the difference in the shrinkage ratio between the front-back/vertical direction and the left-right direction of the membrane is obtained by weaving in elastomer yarn having a higher heat shrinkage ratio than the heat shrinkable yarn forming the textile. Here, the elastomer yarn may be woven in as one of the warp and the weft or as both of them. The elastomer yarn may be woven in besides the warp and the weft forming the textile or woven in along one of the warp and the weft or along both of them.

The textile may be woven by using the warp and the weft having the same heat shrinkage ratios at the same heating temperature or may be woven by using the warp and the weft made of at least two kinds of elastic materials having the different heat shrinkage ratios at the same heating temperature. In each case, it is possible to obtain the difference in the shrinkage ratio between the front-back/vertical direction and the left-right direction by using the elastomer yarn disposed along one or both of the warp and the weft.

Further, the membrane is a knit knitted by using heat shrinkable yarn and the difference in the shrinkage ratio between the front-back/vertical direction and the left-right direction of the membrane may be obtained by inserting and knitting the elastomer yarn, having a higher heat shrinkage ratio than the heat shrinkable yarn forming the knit, in a course direction.

In the invention, preferably, density of arrangement of the elastomer yarn varies in different parts of the body support structure. For example, if the body support structure is a seat, more pieces of elastomer yarn are preferably disposed in a three-dimensional face-shaped portion on a front edge side of the membrane than in the other area. If the body support structure is a back, more pieces of elastomer yarn are preferably disposed in a three-dimensional face-shaped portion of a lumbar support portion of the membrane than in the other area.

In the invention, a mesh-like membrane formed by a textile or knit preferably has stitches in a peripheral edge portion including a vicinity of a boundary between the frame member and the mesh-like membrane that are finer than stitches in an inner portion of the peripheral edge portion.

In the invention, the tension is preferably imparted to the membrane by blowing thermal fluid such as hot air or superheated steam to heat the membrane.

Advantageous Effects of Invention

According to the invention, it is possible to form the membrane into the body support face in the intended three-dimensional curved face shape by utilizing the three-dimensional shape of the frame member and the difference in the generated tension caused by the difference in the heat shrinkage amount between the front-back/vertical direction and the left-right direction of the membrane.

If the shrinkage ratio in the direction with a smaller amount of displacement in a depth direction out of the front-back/vertical direction and the left-right direction of the membrane is higher than the shrinkage ratio in the direction with a larger amount of displacement in the depth direction, the tension in the direction with the smaller heat shrinkage amount is restricted by the tension of the membrane in the direction with the larger heat shrinkage amount and the tension in the direction with the smaller heat shrinkage amount is greatly affected by the tension in the direction with the larger heat shrinkage amount. As a result, the entire membrane shrinks along the three-dimensional shape of the frame member to easily form the intended three-dimensional body support face.

In the invention, if the membrane is formed by the textile woven by using the heat shrinkable warp and weft and the elastomer yarn having the higher heat shrinkage ratio than the heat shrinkable yarn forming the textile is woven in, it is possible to obtain a large difference in the heat shrinkage ratio between the front-back/vertical direction and the left-right direction. Therefore, it is possible to impart arbitrary tension without being affected by overall shrinkage of the membrane. Thus, while the membrane itself shrinks with heat throughout itself and equally in the front-back/vertical direction and the left-right direction, the elastomer yarn highly shrinks with heat to obtain the tension. Therefore, sufficient tension can be obtained and the body support face of the membrane can be formed along the shape of the frame member supporting opposite ends of the elastomer yarn.

Furthermore, if the membrane is formed by weaving the elastomer yarn having the higher heat shrinkage ratio than the heat shrinkable yarn forming the textile or the knit, it is possible to easily obtain the difference in the shrinkage ratio of the membrane between the front-back/vertical direction and the left-right direction by only adjusting a manner of weaving in of the elastomer yarn, for example, the direction of disposition, the number of pieces, density of the arrangement, and the thickness of the elastomer yarn. Therefore, while imparting the necessary tension to the membrane itself, it is possible to form the three-dimensional body support face along the shape of the frame member by means of the difference in the tension between the front-back/vertical direction and the left-right direction of the membrane.

In the invention, if the density of the arrangement of the elastomer yarn varies in different parts of the body support structure, it is possible to increase a bounce of the part having the increased density of the arrangement of the elastomer yarn and performance of the three-dimensional face-shaped portion of the front edge portion in the case of the seat or the three-dimensional face-shaped portion of the lumbar support portion in the case of the back for supporting a body of a user.

In the invention, if the stitches in the peripheral edge portion including the vicinity of the boundary between the frame member and the mesh-like membrane formed by the textile or the knit are finer than stitches in an inner portion of the peripheral edge portion, burrs are not formed by resin oozing into the membrane during injection molding of the frame member. Therefore, an operation step of removing the burrs becomes unnecessary, which reduces the number of man-hours for the operation and cost.

In the invention, if the tension is imparted to the body support structure by blowing the thermal fluid to the membrane with the peripheral edge fixed to the frame member, even if the membrane before the heating slacks as if it waves greatly because of conspicuous displacement in the three-dimensional directions, local temperature differences do not occur, which prevents irregular shrinkage causing dark-colored portions and light-colored portions and color irregularities.

DESCRIPTION OF EMBODIMENTS

Figure 1:
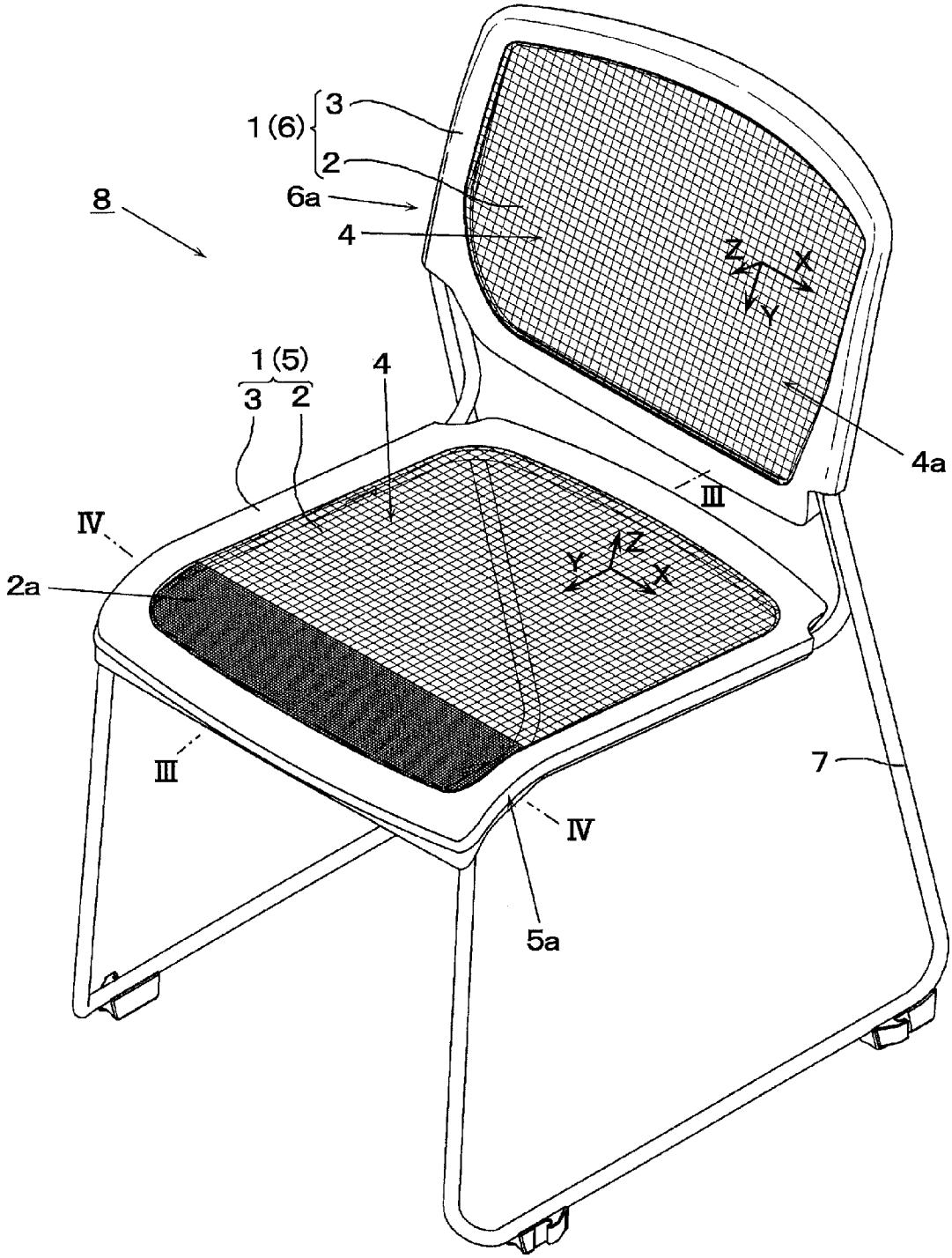
FIG. 1 is a perspective view of an embodiment of a chair including body support structures having membranes forming body support faces according to the present invention.

A structure of the present invention will be specifically described below based on embodiments shown in the drawings.

FIG. 1 shows, as an embodiment of a chair of the invention, a pipe chair including, as a seat and a back, body support structures having membranes forming body support faces which support a body of a user. The chair 8 includes the seat 5 and the back 6 which are formed by body support structures 1 each formed by the membrane 2 and a frame member 3 for supporting a peripheral edge of the membrane 2 and which are supported by a pipe frame 7. In the present description, vertical, front-back, left-right directions are determined with reference to the user seated on the seat 5 of the chair, directions of three axes, that is, a front-back/vertical direction (y-axis), a left-right direction (x-axis), and a depth direction (z-axis) orthogonal to each other and forming three-dimensional coordinates are determined with reference to the body support face of each of the respective body supporting structures defined as an xy-plane, and a direction of a front-back/vertical axis (y-axis) of the three-dimensional coordinates is defined as a direction which agrees with a front-back direction or a vertical direction of the chair.

Each of the body support structures 1 includes the frame member 3 in a three-dimensional shape and forming a three-dimensional body support face 4 expanded in the three axial directions, that is, the front-back/vertical direction, the left-right direction, and the depth direction orthogonal to each other and the membrane 2 formed by fixing a peripheral edge portion of the membrane 2 to the frame member 3 under no tension or tension lower than tension required of the body support face 4 and imparting the tension required of the body support face 4 by heat shrinkage by heating after the fixing. Heat shrinkage ratios of the membrane 2 in the front-back/vertical direction and the left-right direction are different from each other and a difference in tension generated in the heat shrinkage forms the three-dimensional body support face 4 along the shape of the frame member 3.

Figure 3:
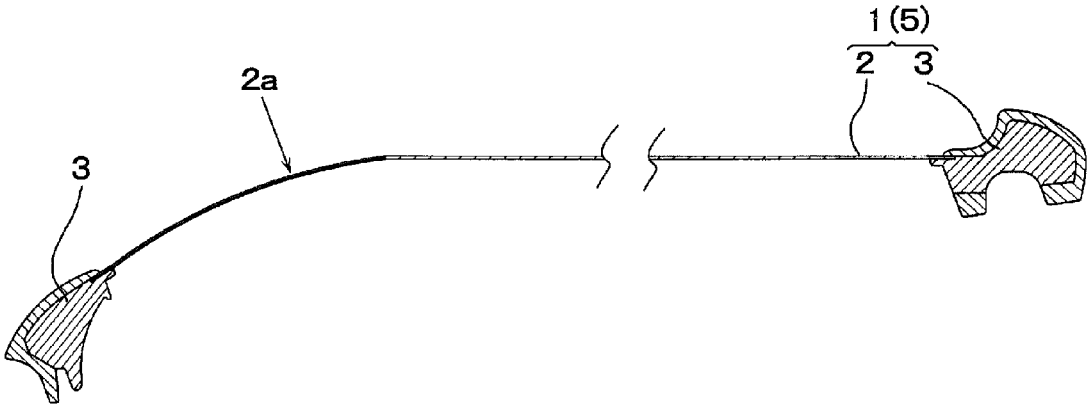
FIG. 3 is an end view of the seat along line III-III in FIG. 1.
Figure 4:
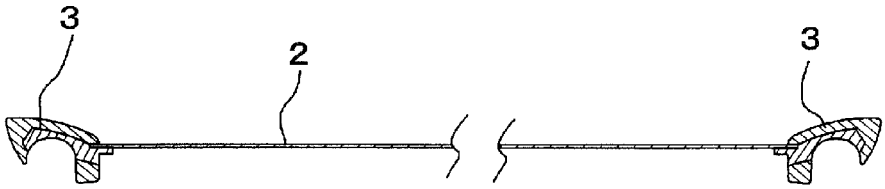
FIG. 4 is an end view of the seat along line IV-IV in FIG. 1.

Here, the frame member 3 is molded into a desired three-dimensional shape, as a member having rigidity for maintaining tension of the membrane 2 by itself, by using thermoplastic synthetic resin, for example, polyester such as polyethylene terephthalate (PET) and olefin resin such as polypropylene (PP) or thermosetting synthetic resin which sets at a lower temperature than the membrane 2. For example, in the case of the body support structure 1 forming the seat 5 of the chair shown in FIG. 1, a front zone 5*a* of the seat 5 is curved downward as shown in FIGS. 1 and 3 and a front edge zone 2*a* of the membrane 2 also forms a curved face curved downward along the front zone 5*a* so as to minimize pressure applied on backs of thigh portions near knees of the user. In the case of the body support structure 1 forming the back 6 of the chair shown in FIG. 1, a lumbar zone 6*a* of the back 6 is slightly curved forward in a direction of y-axis, the entire back 6 is slightly curved to protrude backward in a direction of x-axis, and the body support face 4 having a lumbar area 4*a* for supporting a lumbar part of the user is formed along the back 6. In the embodiment, the frame member 3 is made of olefin resin, the membrane 2 is made of polyester, and the frame member 3 and the membrane 2 are joined to each other without using metal such as screws so that the body support structure 1 can be recycled as it is without separated and disposed of. However, it does not mean that materials of the membrane 2 and the frame member 3 are restricted to the examples in the embodiment. Moreover, not the entire frame member 3 needs to be made of the single material. Depending on circumstances, reinforcing material such as fiberglass and carbon fibers may be filled into portions which need to have strength.

The membrane 2 includes every membrane-shaped object made of heat shrinkable material having flexibility generating tension for allowing the body support structure 1 such as the seat 5 or the back 6 of the chair to exert strength and elasticity required of the body support structure 1. For example, it is possible to use the membrane 2 in a form of a textile, a knit, a mesh formed by a textile or a knit, a nonwoven fabric, or a film. It is preferable to use a textile or a knit formed by thermoplastic resin fibers such as polyester yarn and nylon yarn or a mesh formed by a textile or a knit (which are collectively and simply referred to as "mesh" in the present description) and it is the best preferable to use the membrane 2 in the form of mesh. If the membrane 2 is the mesh, high breathability can be obtained and therefore it is possible to obtain the body support structures 1 which are comfortable to sit and cozy. Of course, the membrane 2 is not restricted to the mesh but may be a membrane-like object, if it has a heat shrinkable property and has elasticity and strength required of the body support structure 1. For example, the membrane 2 may be the membrane-like object made of different material such as a textile, a knit, a nonwoven fabric, and a film.

Figure 2:
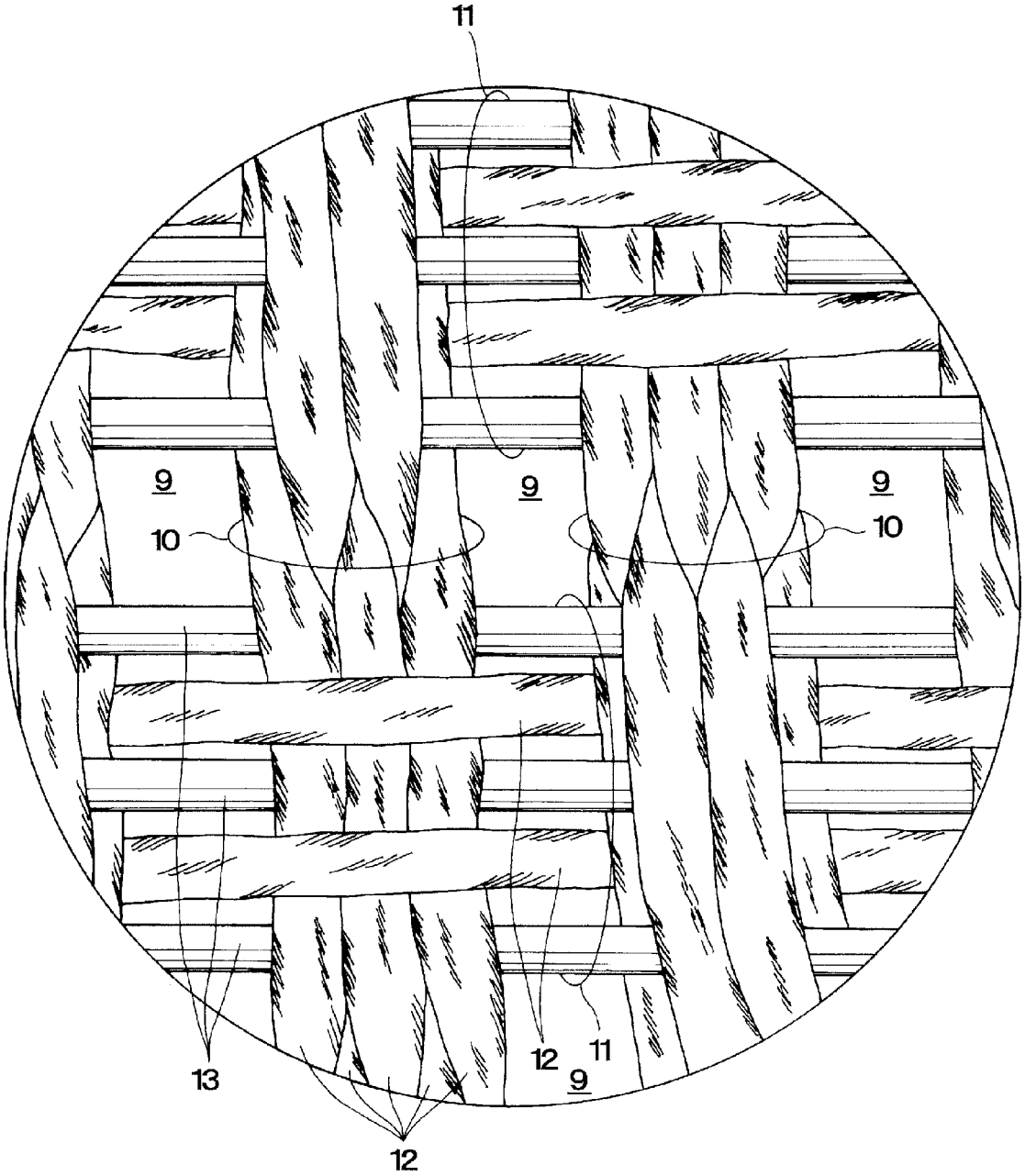
FIG. 2 is an enlarged view of the embodiment of the membrane of a seat.

The membrane 2 is made of elastic member having a heat shrinkable property and has different heat shrinkage ratios between a front-back/vertical direction and a left-right direction. For example, the membrane 2 in the embodiment is formed by the mesh having a base fabric woven by using warp 10 and weft 11 including a plurality of strands (hereafter referred to as "polyester strands" or simply referred to as "polyester yarn") 12 formed by twisting pieces of polyester yarn as shown in FIG. 2 and slightly shrinks both in a warp direction and a weft direction through heating treatment. The heat shrinkage ratios in the front-back/vertical direction and the left-right direction of the membrane 2 are different from each other so that the heat shrinkage ratio in the direction in which the membrane 2 needs to shrink more, that is, the direction with a smaller amount of displacement in a depth direction out of the front-back/vertical direction (y-axis direction) and the left-right direction (x-axis direction) of the membrane 2 is higher than the heat shrinkage ratio in the direction with a larger amount of displacement in the depth direction and that a difference in generated tension is caused between the front-back/vertical direction and the left-right direction in the heat shrinkage. For example, if the seat 5 of the chair in the embodiment in FIG. 1 is taken as an example, pieces of elastomer polyester yarn (hereafter simply referred to as "elastomer yarn") 13 formed by monofilaments are woven along the weft 11 of the polyester strands in the left-right direction (x-axis direction) in FIG. 2 so that stronger tension is imparted in the left-right direction, that is, the direction of the weft 11 through the heating treatment. In other words, by weaving the polyester yarn 12 into the mesh-like base fabric portion which equally shrinks with heat in both the front-back and left-right directions and by weaving the pieces of elastomer yarn 13 having a higher heat shrinkage ratio than ground yarn, that is, the polyester yarn 12 along the ground yarn in one direction of the base fabric, a difference in the shrinkage ratio between the front-back and left-right directions is obtained in shrinkage of the entire membrane 2. To put it concretely, the mesh is woven by using the warp 10 formed by the five polyester strands 12 and the weft 11 formed by alternately arranging the two polyester strands 12 between the three elastomer polyester monofilaments 13 having the higher heat shrinkage ratios than the polyester yarn 12. Therefore, if the seat 5 of the chair in the embodiment in FIG. 1 is taken as the example, at curved portions 5*a* of the frame member 3, the elastomer polyester yarn 13 in the left-right direction linearly connects the curved portions 5*a* (see FIG. 2) and the polyester yarn 12 in the front-back direction is restricted by tension of the elastomer polyester yarn 13 and formed into a shape along the arrangement of the pieces of elastomer polyester yarn 13, that is, a shape along sides 3*a* of the frame member 3. As a result, as shown in FIG. 3, the membrane 2 forms a curved face 2*a* corresponding to the curved portion 5*a* of the frame member 3. Here, as the elastomer yarn 13, it is preferable to use material, having a higher heat shrinkage ratio than the heat shrinkable elastic yarn forming the base fabric, that is, the ground yarn, for example, thermoplastic elastomer material such as polyester, urethane, nylon, olefin, styrene, polyvinyl chloride. It is especially preferable to use the polyester and urethane thermoplastic elastomer.

The numbers of pieces in warp 10 and weft 11 are not restricted to five and five as in the above description and any numbers of pieces may be combined to form the warp 10 and the weft 11 depending on needs. For example, the difference in the shrinkage ratio between the front-back/vertical direction and the left-right direction may be obtained by weaving the mesh with warp 10 formed by five polyester strands 12 and weft 11 formed by arranging one polyester strand 12 between two elastomer polyester monofilaments 13. The elastomer yarn 13 does not necessarily have to be the monofilament but may be a strand depending on circumstances. Moreover, the elastomer yarn 13 does not necessarily have to be woven as part of the ground yarn of the base fabric, that is, the weft 11 or the warp 10. Depending on circumstances, the elastomer polyester monofilament 13 may be woven alone as insertion yarn into stitches 9 of the mesh, for example, besides the base fabric portion. Although the warp 10 of the membrane 2 formed by the mesh-like textile and the weft 11 are disposed with respect to the frame member 3 so as to respectively correspond to the front-back/vertical direction (y-axis direction) of the body support structure 1 and the left-right direction (x-axis direction) of the body support structure 1 in the embodiment, they are not restricted to this correspondence relationship. Reversely to the relationship shown in the drawing, the warp 10 may be disposed to correspond to the left-right direction (x-axis direction) of the body support structure 1 and the weft 11 may be disposed to correspond to the front-back/vertical direction (y-axis direction) of the body support structure 1.

The structure of the membrane 2 is not necessarily restricted to that in the above-described embodiment. For example, a preferable embodiment may be a mesh woven by using warp 10 and weft 11 made of different materials, for example, at least two kinds of elastic materials having different heat shrinkage ratios at the same heating temperature. Moreover, all pieces of one of warp 10 and weft 11 may be elastomer polyester yarn 13 and all pieces of the other may be polyester yarn 12 regardless of whether the pieces are strands or monofilaments and a textile or a mesh formed by the textile may be woven by using the warp 10 and the weft 11. Not all of the pieces of warp 10 and weft 11 need to include elastomer yarn 13. Depending on circumstances, the elastomer yarn 13 may be thinned out and only part of the pieces of warp 10 and weft 11 may include the elastomer yarn 13. Furthermore, when the elastomer polyester monofilaments 13 are woven alone into the stitches 9 in the mesh besides the ground yarn of the base fabric, the monofilaments 13 may not be threaded through all the stitches 9 and may be thinned out.

It is also possible to use the elastomer yarn 13 for both the warp 10 and the weft 11 to weave the membrane 2 formed by a textile or a mesh formed by the textile. The pieces of elastomer yarn 13 may be woven as parts of the pieces of weft 11 and warp 10 or all the pieces of warp 10 and weft 11 may be formed by the pieces of elastomer polyester yarn 13 depending on circumstances. In this case, by using pieces of thermoplastic elastomer yarn having different heat shrinkage ratios for the elastomer yarn 13 as the weft 11 and for the elastomer yarn 13 as the warp 10, it is possible to obtain the membrane 2 having a difference in the shrinkage ratio between the front-back/vertical direction and the left-right direction. Moreover, it is possible to obtain the membrane 2 having a difference in the shrinkage ratio between the front-back/vertical direction and the left-right direction by respectively weaving in the pieces of elastomer yarn 13 along the warp 10 or the weft 11 or both of them besides the ground yarn of the warp 10 and the weft 11 forming the base fabric. In any cases, the elastomer yarn 13 can be woven in as the warp 10 and the weft 11 or as insertion yarn separately from them regardless of whether the pieces of elastomer yarn 13 are strands or monofilaments. If pieces of elastomer yarn 13 having the same heat shrinkage ratios are used as pieces of warp 10 and weft 11 or as pieces of insertion yarn disposed along both of the warp 10 and the weft 11, it is possible to obtain a difference in generated tension between the front-back/vertical direction and the left-right direction of the membrane 2 by adjusting the number and thickness of pieces of elastomer yarn 13 to be used. Moreover, it is also possible to use, as the membrane 2, a film having different heat shrinkage amounts in the front-back/vertical direction and the left-right direction, for example, a film made of polyvinylidene chloride.

Moreover, when the membrane 2 is formed by pieces of warp 10 and weft 11 having the same heat shrinkage ratios, it is possible to achieve differences in shrinkage amount and tension between the front-back/vertical direction and the left-right direction of the membrane 2 by weaving the different numbers of strands or monofilaments of the warp 10 and the weft 11, that is, by weaving the pieces of warp 10 and weft 11 in different densities or weaving the different numbers of pieces of warp 10 and weft 11, for example. In this case, the number of pieces of warp 10 or weft 11 may be changed throughout the membrane 2 or the heat shrinkage amounts of a part and the other part of the membrane 2 may be different from each other. Depending on circumstances, the difference in the shrinkage ratio between the front-back/vertical direction and the left-right direction may be obtained by weaving in the different numbers of pieces of elastomer yarn 13 into the warp 10 and the weft 11, respectively.

It is also possible to achieve different tension depending on a portion of the body support face by weaving in the different number of pieces of elastomer polyester yarn 13 formed by a monofilament or a strand to thereby obtain different density of arrangement depending on a portion of the body support structure 1. For example, if the body support structure 1 is the seat 5, it is preferable to arrange more pieces of elastomer yarn 13 in the front edge zone 2*a*, that is, a three-dimensional face-shaped portion on a front edge side of the membrane 2 than in the other area in order to support thigh portions near knees of the user. If the body support structure 1 is the back 6, it is preferable to arrange more pieces of elastomer yarn 13 in a three-dimensional face-shaped portion of a lumbar support area 4*a* of the membrane 2 than in the other area in order to support a lumbar part of the user.

Figure 11A:
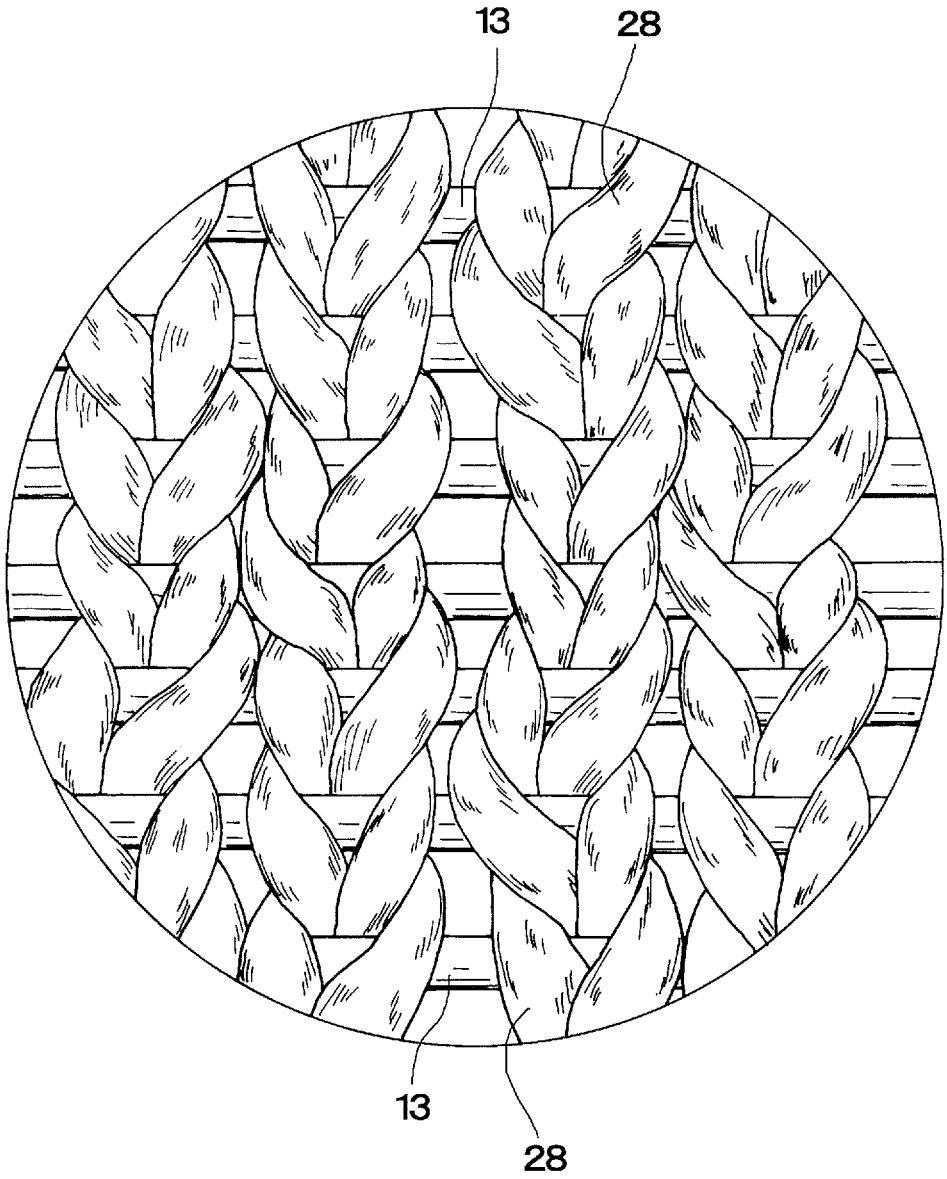
FIG. 11A is an enlarged view of an embodiment of a membrane formed by a knit.
Figure 11B:
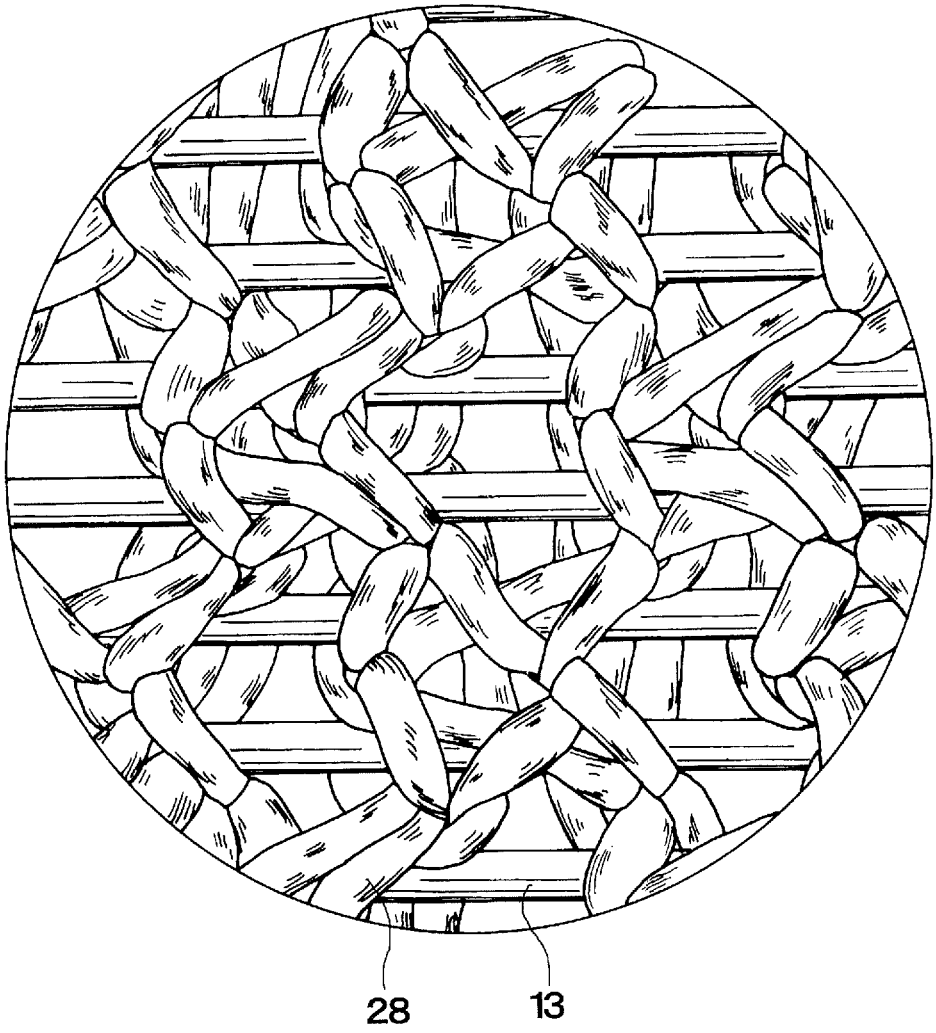
FIG. 11B is an enlarged view of another embodiment of the membrane formed by the knit.

Another preferable embodiment is that the membrane 2 is a knit knitted by using heat shrinkable elastic yarn or a mesh formed by a knit. For example, as shown in FIG. 11A or 11B, heat shrinkable elastic material may be employed as ground yarn 28 and elastomer yarn 13 different from the ground yarn 28 may be inserted and knitted into in a course direction (left-right direction) throughout knitted fabric. In this case, due to the elastomer yarn 13 having a higher heat shrinkage ratio than the heat shrinkable ground yarn 28 forming the knitted fabric, a knit structure having a difference in the heat shrinkage ratio of the membrane 2 between a front-back/vertical direction and a left-right direction is obtained. The pieces of elastomer yarn 13 are arranged in a wale direction (front-back/vertical direction) so as to pass through the base knitted fabric formed by the ground yarn 28. The pieces of elastomer yarn 13 may be arranged with a constant pitch in the wale direction or may be arranged densely or sparsely depending on needs. Moreover, a knitting method of the base knitted fabric is not limited to a certain method.

Even if the pieces of yarn are made of the same material, it is possible to achieve a difference in the shrinkage amount between a front-back/vertical direction and a left-right direction by means of manufacturing methods. For example, because there is an upper limit to the shrinkage amount of the elastomer yarn 13, the polyester yarn 12 and the elastomer yarn 13 are shrunk with heat by heating the membrane 2 before fixing the membrane 2 to the frame member 3, for example, in finishing the membrane 2 in a weaving step of a manufacturing stage of the membrane 2. Because a shrinkage amount of the elastomer yarn 13 is large at this time, a shrinkage amount of the elastomer yarn 13 in a tension imparting step carried out for the membrane 2 after mounting the membrane 2 to the frame member 3 is small. Taking advantage of this characteristic, it is possible to adjust the shrinkage amount of the elastomer yarn 13 in the tension imparting step for the membrane 2 to a desired amount by adjusting temperature in manufacture of the membrane 2. Furthermore, for example, a shrinkage amount of the polyester yarn 12 varies depending on a dyeing method including temperature at which the yarn is heated in dyeing and the number of times of heating. Therefore, by selecting the dyeing method, it is possible to adjust the shrinkage amount of the polyester yarn 12 in the tension imparting step for the membrane 2 to a desired amount. Moreover, by suitably selecting a sectional shape, thickness, and the like of the yarn forming the membrane 2, it is possible to adjust the shrinkage amount of the yarn in the tension imparting step for the membrane 2 to a desired amount.

Here, if a textile or a mesh formed by a knit is used as the membrane 2, this is based on a concept of attaching importance to breathability and therefore the manner of weaving/knitting of the mesh itself is sparse, that is, the stitches are rough while securing sufficient strength to support the user. Therefore, when the mesh-like membrane 2 is set as an insert in an injection molding die and the frame member 3 is molded by injection molding, resin leaks out from die face portions of upper and lower dies between which the mesh-like membrane 2 is sandwiched and the resin may ooze into the stitches of the mesh-like membrane 2. In this case, resin burrs may be produced between the mesh-like membrane 2 on an inner side of the frame member 3 and the frame member 3. Especially, when a die clamping force is increased in order to completely prevent leakage of the resin from the die face portions of the dies, the mesh sandwiched between the dies may be squashed and damaged or torn. Therefore, it is impossible to increase the die clamping force enough to completely prevent the leakage of the resin. The burrs produced by the leakage of the resin (oozing into the mesh) caused in the injection molding may touch and sting the thighs or the back of the user to bring a discomfort feeling, may hurt skin, may make a run in stockings, or may scratch clothes. Therefore, in a manufacturing process of a prior-art mesh, a step of removing the burrs is required at the end, which causes increase in the number of man-hours for the operation and increase in cost.

Therefore, in the body support structure of the chair according to the embodiment, the stitches of the membrane 2 in a portion where the burrs can be problems, for example, in a boundary portion between a peripheral edge portion of the membrane 2 and the frame member 3 are made finer than in the other inner area. Especially, the stitches in a boundary portion which is between the body support face and the frame member and which is highly likely to come in contact with the body of the user are preferably made finer than the other portion. To put it concretely, in the case of the seat 5 of the chair in the embodiment in FIG. 1, the leakage of the resin may occur in the injection molding of the frame member 3 in a boundary portion between the portion of the frame member 3 curved downward and set in the front edge zone 5*a* of the seat 5 and the membrane 2 forming the curved face along the portion and therefore the stitches of the membrane 2 in the curved face portion 2*a* are made fine and close. At the same time, the curved face portion 2*a* of the membrane 2 in the front edge zone 5*a* of the seat 5 requires high tension in order to support the backs of the thigh portions near the knees of the user so that the backs of the thigh portions do not touch a front side 3*b* of the frame member 3. Therefore, it is desired that density of the elastomer yarn 13 in the curved face portion 2*a* is also increased. For this purpose, by making the stitches of the membrane 2 fine to increase the density and increasing the number of pieces of elastomer yarn 13 to be woven in the left-right direction as compared with that in the other area, both the tension of the membrane 2 and the density of the stitches of the membrane 2 in the curved face portion 2*a* are increased to make the membrane 2 to less liable to sag due to deterioration. In other words, it is possible to locally change a deflection amount of the membrane 2 to thereby reduce a feeling of contact with the frame member 3 felt by the user.

In order to prevent oozing of the resin into the membrane 2 in the injection molding, it is preferable to make the stitches fine and close by narrowing intervals between pieces of weaving yarn in a direction orthogonal to a direction in which the resin leaks out to sides of the mesh-like membrane 2 adjacent to the frame member 3, intervals between pieces of weaving yarn in the same direction as the direction in which the resin leaks out to the sides of the membrane 2 adjacent to the frame member 3, or both the intervals at the same time. To put it concretely, the intervals between the pieces of warp 10 or weft 11 are narrowed or closed up by increasing the number of pieces of weaving yarn as compared with that in the other portion, squeezing and flattening the weaving yarn having circular sections, or dividing and spreading a bunch of a plurality of strands. If the membrane 2 is formed by the knit, the stitches of the membrane 2 can be made fine by making loops of the knit fine.

The area in which the stitches of the mesh-like membrane 2 are made fine and close is an area including a portion occupying a relatively inner side of the frame member 3 and a peripheral edge outside the portion. Of course, a width of the area in which the stitches existing on the inner side of the frame member 3 are made fine is not restricted to a certain width. In other words, the width is set suitable so as to prevent the leakage of the resin, for molding the frame member 3, to the membrane 2 in the integral molding of the membrane 2 and the frame member 3 and to secure at least a necessary width to prevent formation of the burrs at the sides of the membrane 2 adjacent to the frame member 3.

Figure 7:
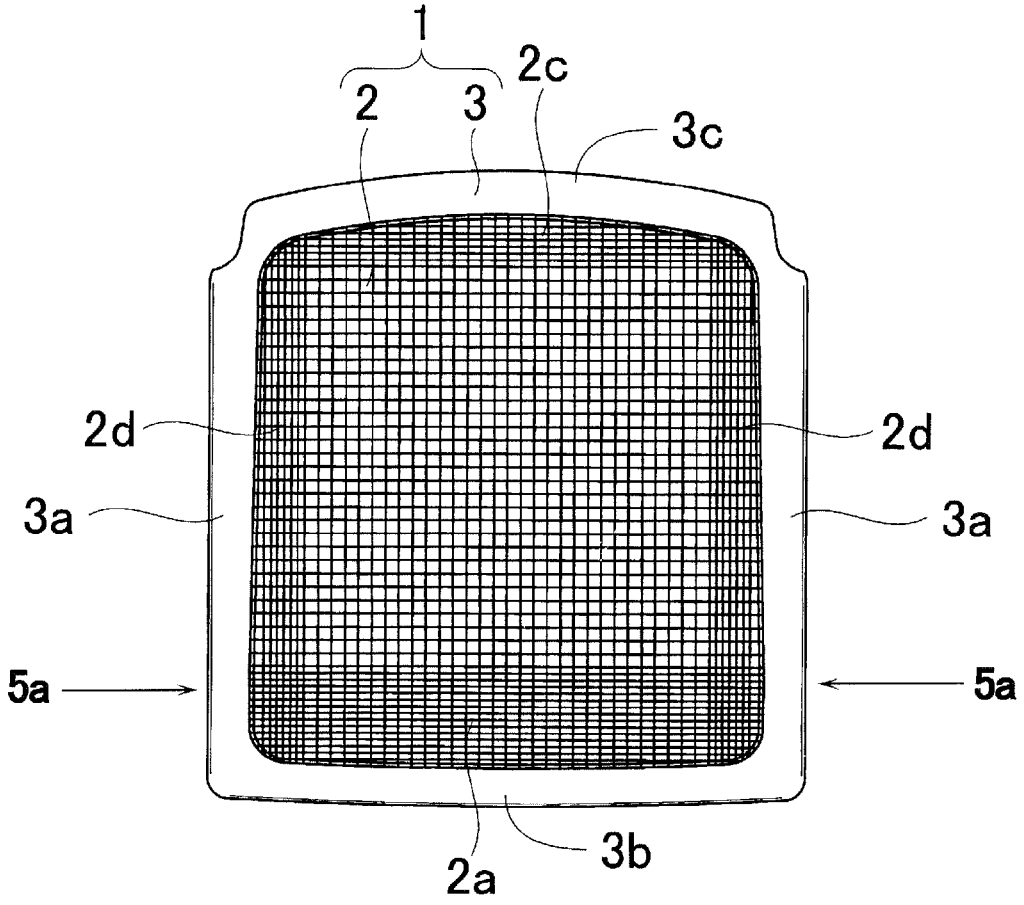
FIG. 7 is a plan view showing an example of a seat having a mesh-like textile with fine and close stitches throughout a peripheral edge portion.

The portion where the stitches of the mesh-like membrane 2 are finer than in the other portion, that is, a dense portion is not restricted to the front edge portion 2*a* of the seat 5 shown in FIG. 1 but may be provided to the other portion or the entire area of the peripheral edge portion of the membrane 2 near the boundary between the frame member 3 and the membrane 2, if such a portion or area may come in direct contact with the user. To put it concretely, the above-described dense portion may be provided throughout the front edge portion 2*a*, a rear edge portion 2*c*, and left and right side edge portions 2*d* of the membrane 2 as shown in FIG. 7. Although it is not shown in the drawings, the above-described dense portion may be provided in both of the front edge portion 2*a* and the rear edge portion 2*c*, in the rear edge portion 2*c* only, or in the left and right side edge portions 2*d* only depending on circumstances. In this case, the leakage of the resin is prevented by narrowing intervals between pieces of weft 11 at the front edge 2*a* and the rear edge 2*c*, by narrowing intervals between pieces of warp 10 at the left and right side edges, or by narrowing intervals between pieces of weft 11 and intervals between pieces of warp 10 at the same time. A dense portion is set similarly when the membrane 2 is applied to the back 6.

According to the chair including the body support structure having the body support face of the membrane formed as described above, by heating after the membrane 2 is fixed to the frame member 3, a combination of the three-dimensional shape of the frame member 3 and a difference in the generated tension between the front-back/vertical direction and the left-right direction in the heat shrinkage of the membrane 2 stretches the three-dimensional body support face 4 along the shape of the frame member 3. Especially, by stretching the membrane having the higher shrinkage ratio in the direction with the smaller amount of displacement in the depth direction than in the direction with the larger amount of displacement in the depth direction out of the front-back/vertical direction and the left-right direction of the membrane 2, it is possible to form the further three-dimensional body support face 4 along the three-dimensional shape of the frame member.

Next, a manufacturing method and a tension imparting method of the body support structure will be described.

The membrane 2 and the frame member 3 can be fixed to each other by various fixing methods such as bonding, screwing, stapling, sewing, fitting of recessed and protruding portions with each other, and sandwiching of the membrane 2 between pieces of the frame member 3 divided into two along the face of the membrane 2 in order to integrate the membrane 2 and the frame member 3 with each other without imparting necessary tension to the membrane 2. However, a method of integrating the membrane 2 and the frame member 3 by insert molding or two-color molding by mounting the membrane 2, cut into a predetermined shape and dimensions in advance, into a die as an insert in molding the frame member 3 by injection molding is preferable, because it simplifies operation steps and improve the appearance. However, it does not mean that the method of fixing the membrane 2 and the frame member 3 is restricted to the insert molding and the two-color molding.

Figure 8A:
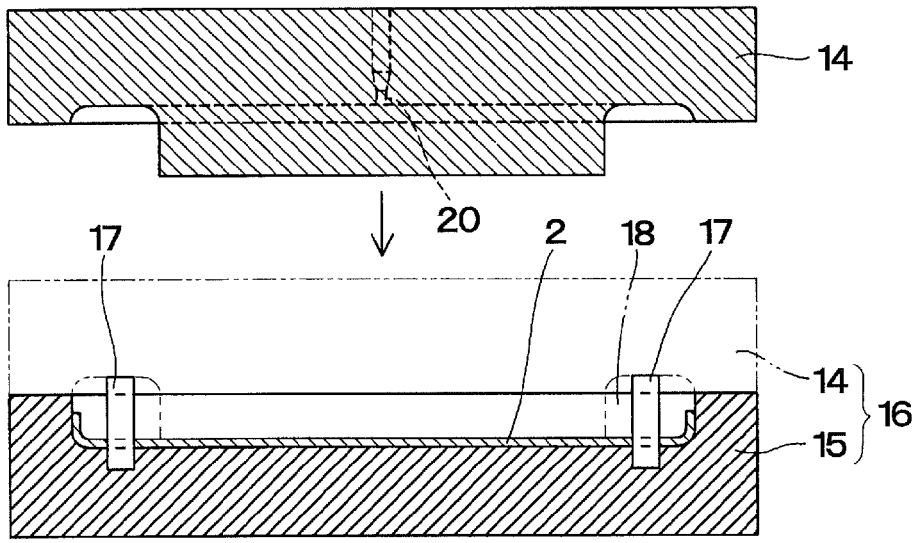
FIG. 8A is a schematic explanatory drawing showing an example of manufacture of a body support structure by insert molding.

When the insert molding is employed, as shown in FIG. 8A, for example, the heat shrinkable membrane 2 is disposed, as the insert under no tension or tension lower than tension required of the body support structure 1, in a die 16 for injection molding of the frame member 3 and formed by an upper die 14 and a lower die 15, the die is closed, and then thermoplastic resin is injected into a cavity 18, in which a peripheral edge of the membrane 2 is housed, and allowed to set to thereby carry out molding of the frame member 3. The peripheral edge portion of the membrane 2 in the cavity 18 is secured to and integrated with an injection molded article, that is, the frame member 3 as it is engulfed by the frame member 3 molded by the injection molding or adheres to a surface of the injection molded article. For example, in the case of the membrane 2 formed by the mesh, the resin flows in the cavity 18 in such manners as to pass through the intervals between pieces of yarn of the fabric of the mesh and cover the membrane 2 during the injection molding of the frame member 3. As a result, the membrane 2 formed in advance is integrated with and secured to the frame member 3 formed by the injection molding. Therefore, a device for pulling the membrane 2 to impart necessary tension in advance is unnecessary in molding the frame member, which simplifies a manufacturing apparatus. Moreover, the edge of the membrane 2 is integrated with the frame member 3 without protruding from the cavity 18, which makes trimming operation for cutting off the membrane 2 from the frame member 3 unnecessary to reduce the number of operation steps and reduce an amount of membrane 2 required to manufacture the body support structure 1.

The membrane 2 does not necessarily have to be fixed in the cavity 18 and the mesh may be merely sandwiched between die face portions of the upper and lower dies 14 and 15 depending on circumstances. However, for example, core pins 17 may be used to pierce and temporarily fix the edge of the membrane 2 when there are the core pins 17 for forming vertical through holes 19 in the frame member 3 as shown in FIG. 8A, fixing means such as core pins and protrusions for fixing the membrane 2 may be prepared separately, or a position of an injection gate 20 for molten resin may be contrived so that a jet force of the molten resin itself jetted into the cavity 18 pushes the membrane 2 against one of faces of the die to thereby fix the membrane 2.

Figure 6:
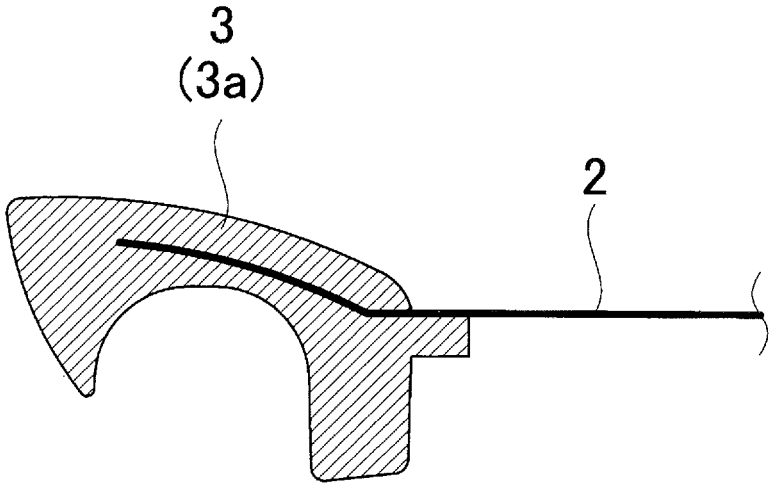
FIG. 6 is a cross sectional view showing a relationship between the membrane and the frame member as a result of insert molding of the seat in FIG. 1.

Here, if the membrane 2 is disposed at a center of the cavity 18 and if core pins (not shown) protruding from both of the upper die 14 and the lower die 15 pinch and fix the membrane 2 in a floating state in the cavity 18, for example, the frame member 3 having a single-layered structure shown in FIG. 6 in which the membrane 2 is completely embedded and integrated into the frame member 3 can be obtained by the insert molding.

Figure 5A:
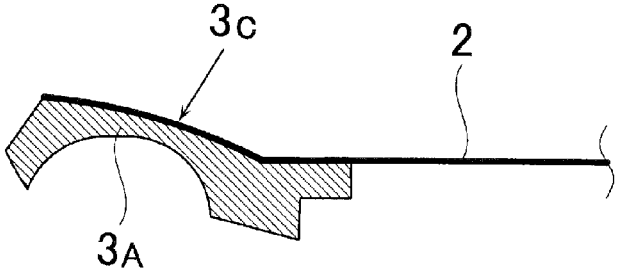
FIG. 5A is a cross sectional view showing a relationship between a membrane and a frame member after primary molding of two-color molding of the seat in FIG. 1.
Figure 5B:
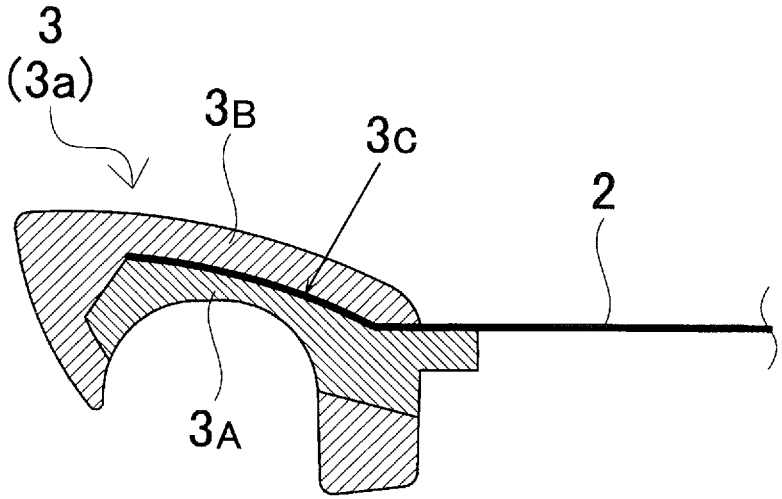
FIG. 5B is a cross sectional view showing a relationship between the frame member and a cover member after secondary molding of the two-color molding of the seat in FIG. 1.

On the other hand, if the membrane 2 in the cavity 18 is not fixed or pushed against the face of the die in the insert molding, the membrane 2 may be exposed to a surface of the frame member 3. In this case, because of requirements in design, it is desired that a joint portion 3C between the frame member 3 and the membrane 2 is covered with and hidden under a cover member 3B to improve the appearance. If the cover member 3B is molded on and integrated with a primary molded article 3A to form a frame member 3 having a two-layered structure, it is possible to reinforce joint strength between the membrane 2 and the frame member 3. Moreover, with the two-color molding, as shown in FIGS. 5A and 5B, it is possible to easily obtain integral molded article formed by the membrane 2 and the frame member 3 with good appearance by forming the multiple-layered structure formed by the primary molded article 3A of the frame member 3 to which the membrane 2 is fixed and the cover member 3B covering an outside of the primary molded article 3A. At this time, it is preferable that the cover member 3B is made of olefin resin or polyester in order to recycle the whole body support structure 1 as it is. Moreover, if the cover member 3B is made of elastomer resin, it is possible to prevent hard members from directly touching the body of the user to prevent pain and a discomfort feeling caused to the user and the cover member 3B becomes comfortable to use. On the other hand, if the cover member 3B is made of resin with high hardness, for example, it is possible to increase strength of the body support structure 1.

Figure 9A:
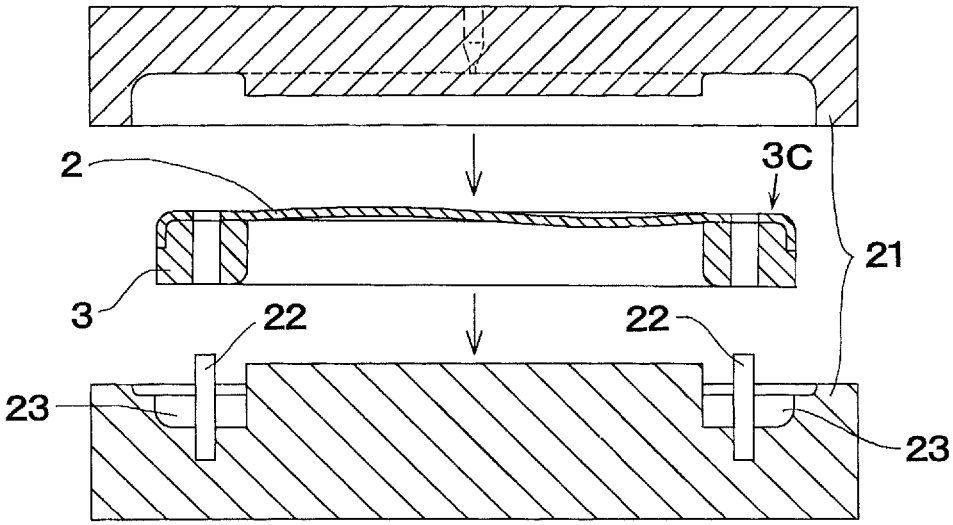
FIG. 9A is a schematic explanatory view showing a state in which an integral object formed by the membrane and the frame member is mounted into a molding die for the cover member.
Figure 9B:
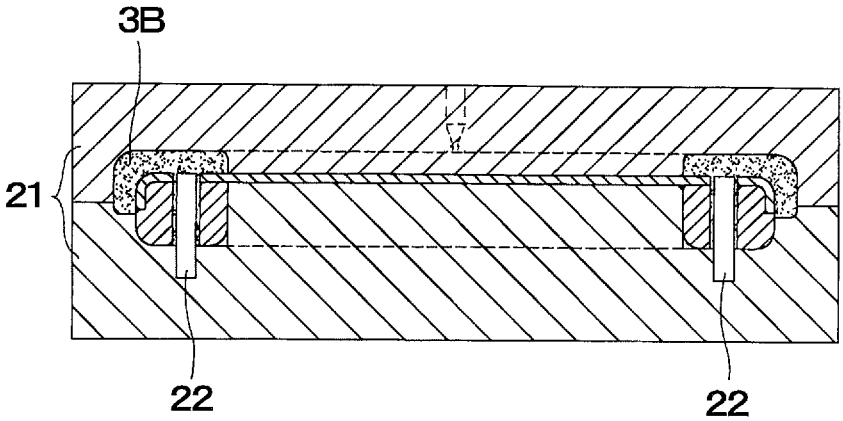
FIG. 9B is a schematic explanatory view showing a state in which resin is injected around the integral object formed by the membrane and the frame member housed in the molding die for the cover member.
Figure 9C:
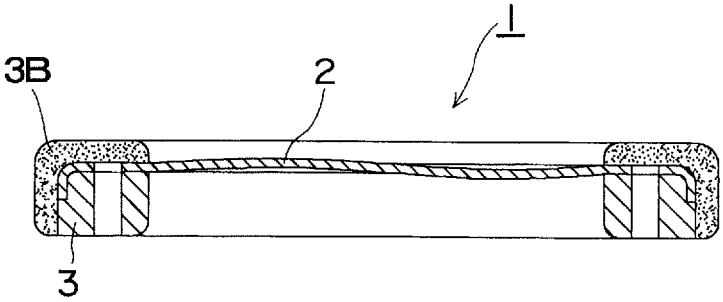
FIG. 9C is a sectional view of the body support structure immediately after taken out of the die and having the cover member molded on a joint between the membrane and the frame member.
Figure 10:
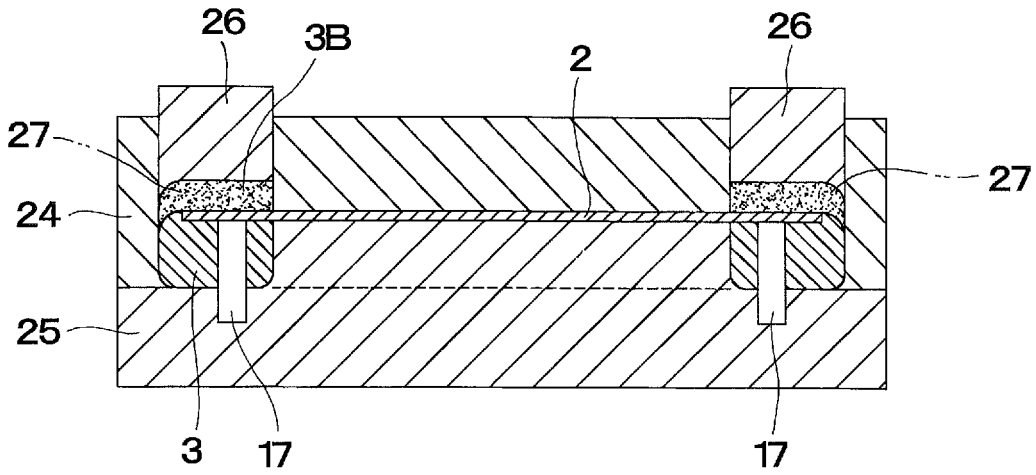
FIG. 10 is a drawing for explaining two-color molding by means of a sliding die and showing a state of secondary molding in which a cover member is molded in a cavity formed on a joint between a membrane and a frame member, which are a primary molded article, by sliding a sliding block.

The cover member 3B is formed on the frame member 3 by two-color molding shown as an example in FIGS. 9A to 9C or two-color molding continuous with insert molding by using sliding dies shown as an example in FIG. 10. In the case of the two-color molding, the primary molded article 3A formed by integrating the frame member 3 and the membrane 2 with each other by insert injection molding by using another die before heating treatment is housed in a cavity 23 of an injection molding die 21 for the cover member 3B while positioned by use of pins 22, for example, as shown in FIG. 9A, thermoplastic resin such as PET and PP is injected around a joint face 3*c* of the primary molded article 3A (see FIG. 9B), and then the body support structure 1 in which the cover member 3B is integrated with the frame member 3 having the two-layered structure and shown as an example in FIG. 9C or FIG. 5B can be obtained. It is also possible to utilize sliding dies 24 and 25 having a sliding block 26 for forming a cavity 27 for secondary molding as shown in FIG. 10 to continuously carry out the injection molding of the frame member 3 and the injection molding of the cover member 3B without opening the dies 24 and 25. In this case, for the injection molding of the frame member 3, the sliding block 26 is fixed in an inner closed position and then the resin is injected into the cavity to mold the frame member 3. Then, the sliding block 26 is caused to recede to and fixed in an outer open position to form the cavity 27 between the frame member 3 and the block 26 and the resin is injected into the cavity 27 to mold the cover member 3B as shown in FIG. 10. It is also possible to employ thermosetting resin as material of the cover member 3B to mold the cover member 3B by compression molding or transfer molding.

Although the frame member 3 is molded by the injection molding by using the membrane 2 as the insert and then moved into another die or the sliding block 26 is shifted in the same die and the cover member 3B is integrally molded around the frame member by the two-color molding in the above-described examples, the invention is not especially restricted to these examples. After injection molding of a frame member 3, only an upper die may be replaced and a cover member 3B may be continuously and integrally molded around the frame member by using an integral molded article formed by the frame member and a membrane 2 as an insert member. A cover member 3B may be molded by two-color molding by using an integral molded article formed by a frame member and the membrane 2 after heating treatment as an insert member. Although it is not shown in the drawings, a cover member 3B formed by injection molding or the like in advance may be secured and integrated by screwing, bonding, or welding so as to cover a joint face 3*c* between the frame member 3 and the membrane 2. Although it suffices that the cover member 3B covers at least a secured portion 3C of the membrane 2 and the frame member 3, the cover member 3B may cover the entire frame member 3 from an upper face to outer side faces as shown in FIG. 5B, for example, depending on circumstances. In this case, the outward appearance can be improved by hiding the joint portion 3*c* between the frame member 3 and the membrane 2 and the body support structure 1 looks as if it is one member, which also improves the appearance.

Moreover, although it is not shown in the drawings, a membrane 2 and a frame member 3 may be integrated with each other by separately molding, by injection molding, two divisions of the frame member 3 divided in a thickness direction along a body support face 4, sandwiching a peripheral edge of the membrane 2 between the divisions, and integrating the divisions of the frame by bonding, screwing, fitting, sewing, or the like. In this case, if fitting portions or fine recessed portions and protruding portions are provided to division faces of the divided half members, it increases forces for sandwiching the membrane.

To the membrane 2 fixed to the frame member 3 in a slack state as described above, desired tension is imparted in the subsequent heating treatment. This heating treatment needs to shrink only the membrane 2 with heat without causing deformation of the frame member 3. For example, in the case of the frame member 3 made of thermoplastic material, the heating treatment is carried out by heating to a sufficient temperature to shrink the membrane 2 with heat while maintaining a lower temperature than a melting temperature of the frame member 3.

Figure 12:
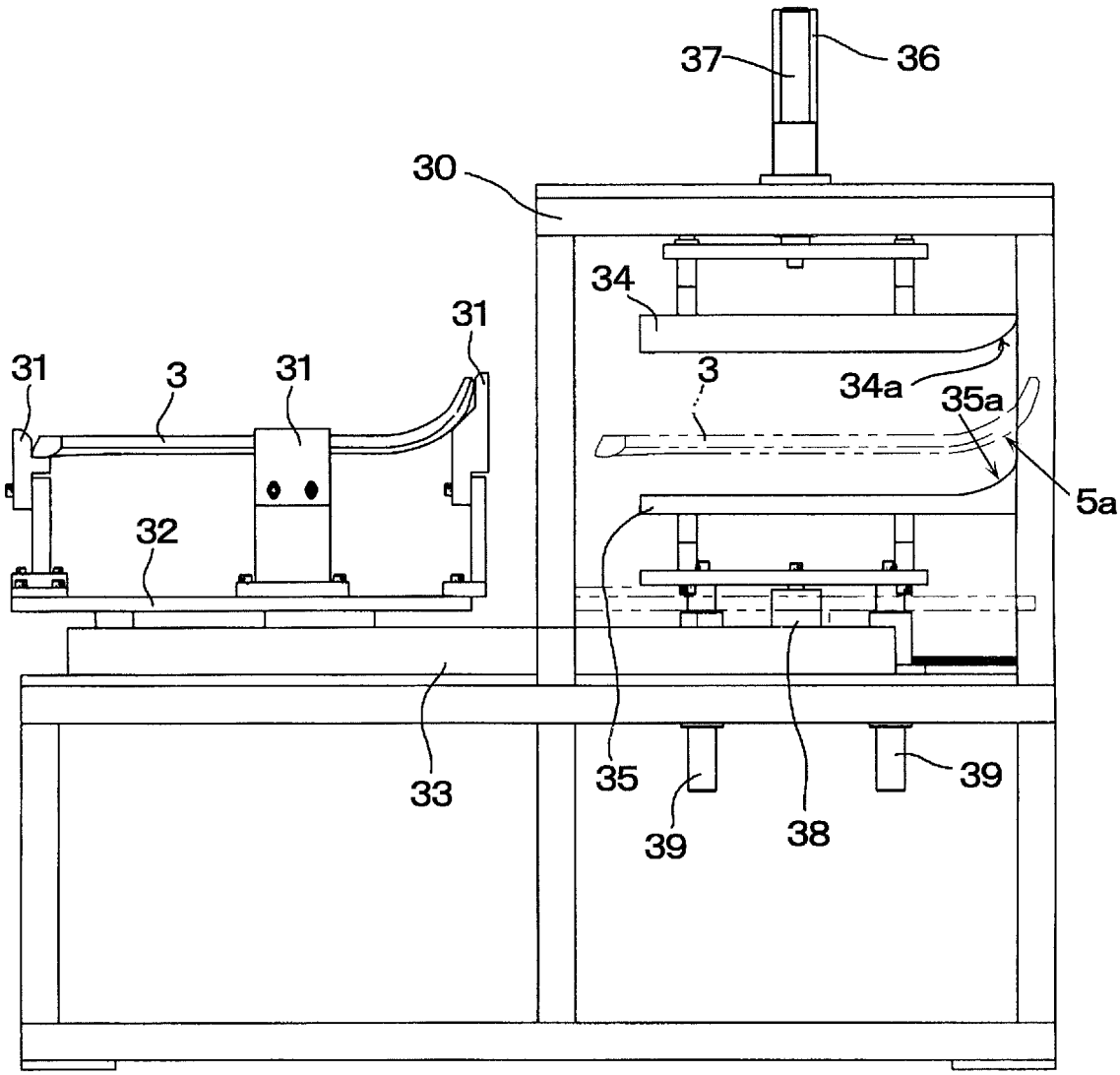
FIG. 12 is a side view of an example of a tension imparting apparatus utilizing heating plates.
Figure 13:
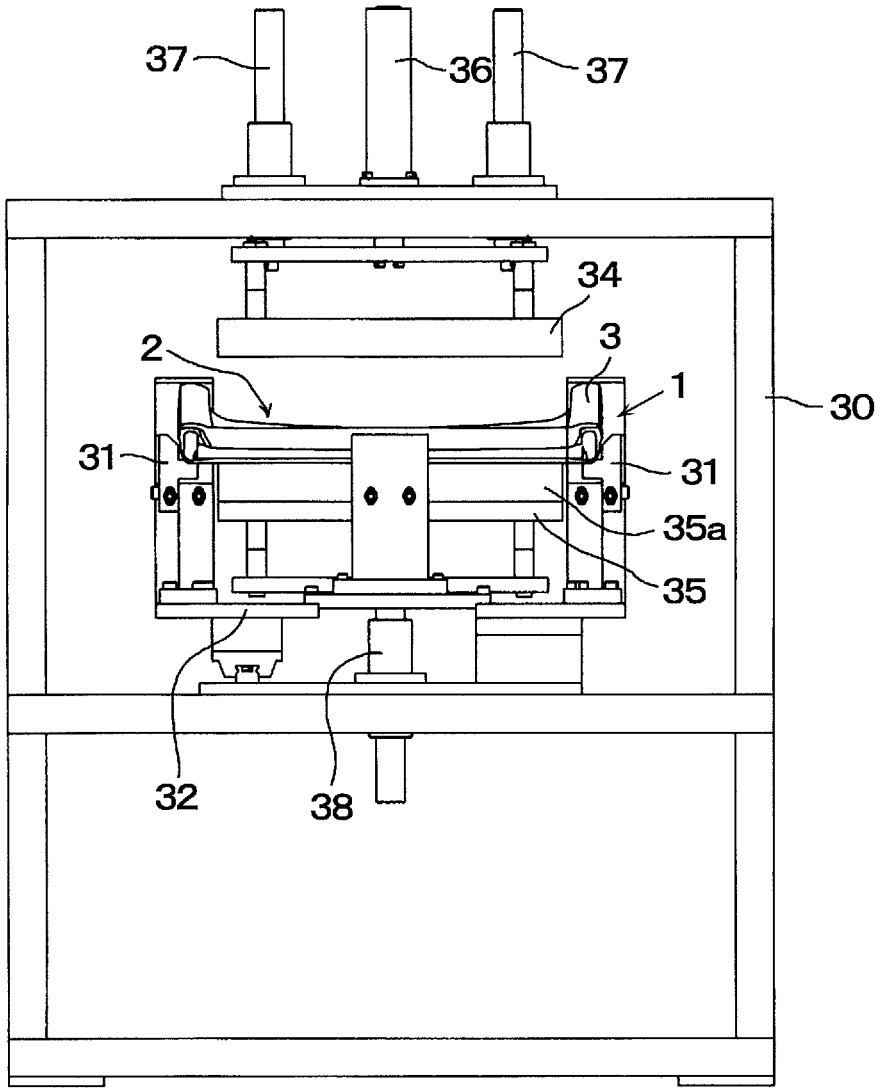
FIG. 13 is a front view of the apparatus.
Figure 14:
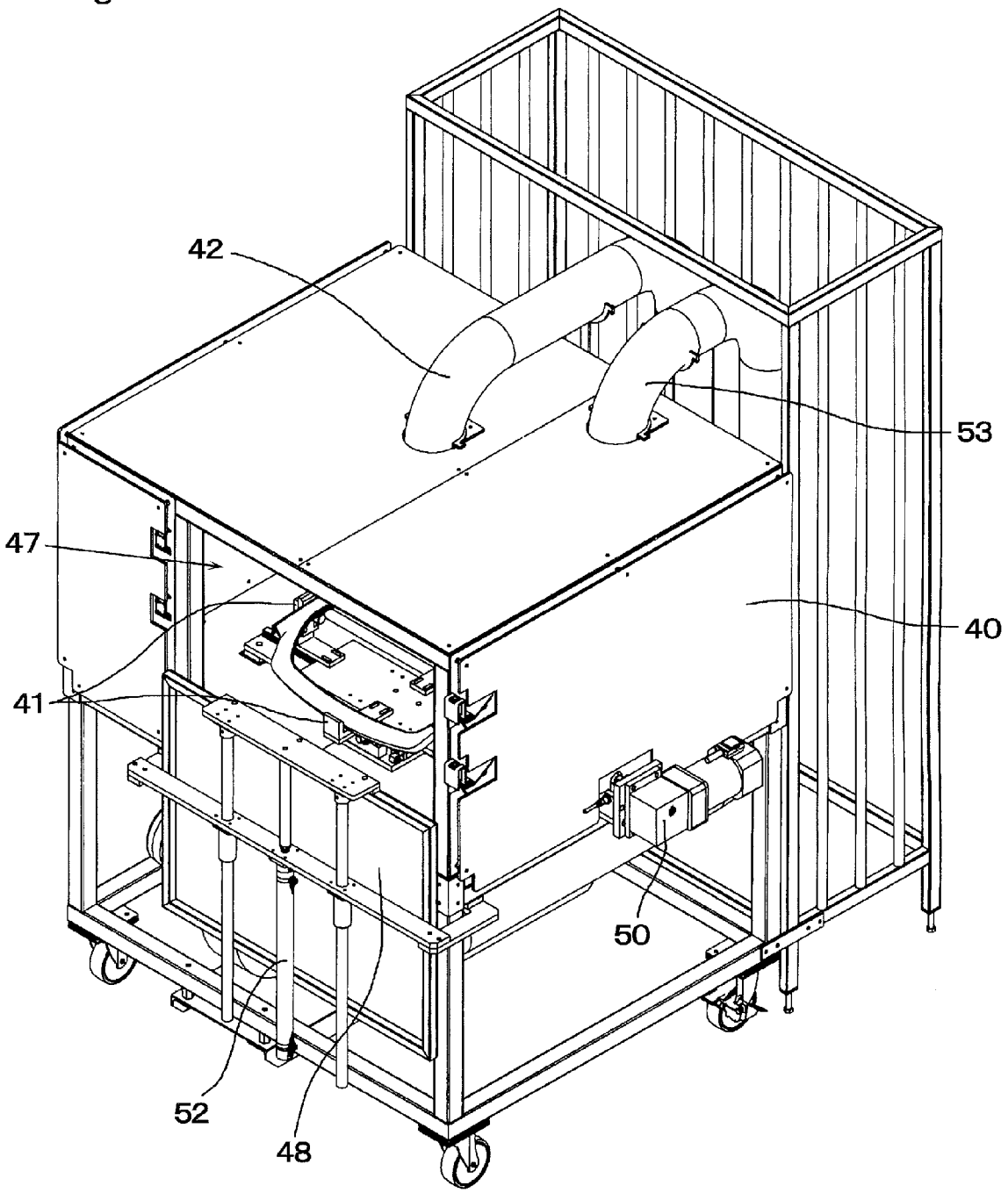
FIG. 14 is a perspective view of an example of a tension imparting apparatus utilizing thermal fluid.
Figure 15:
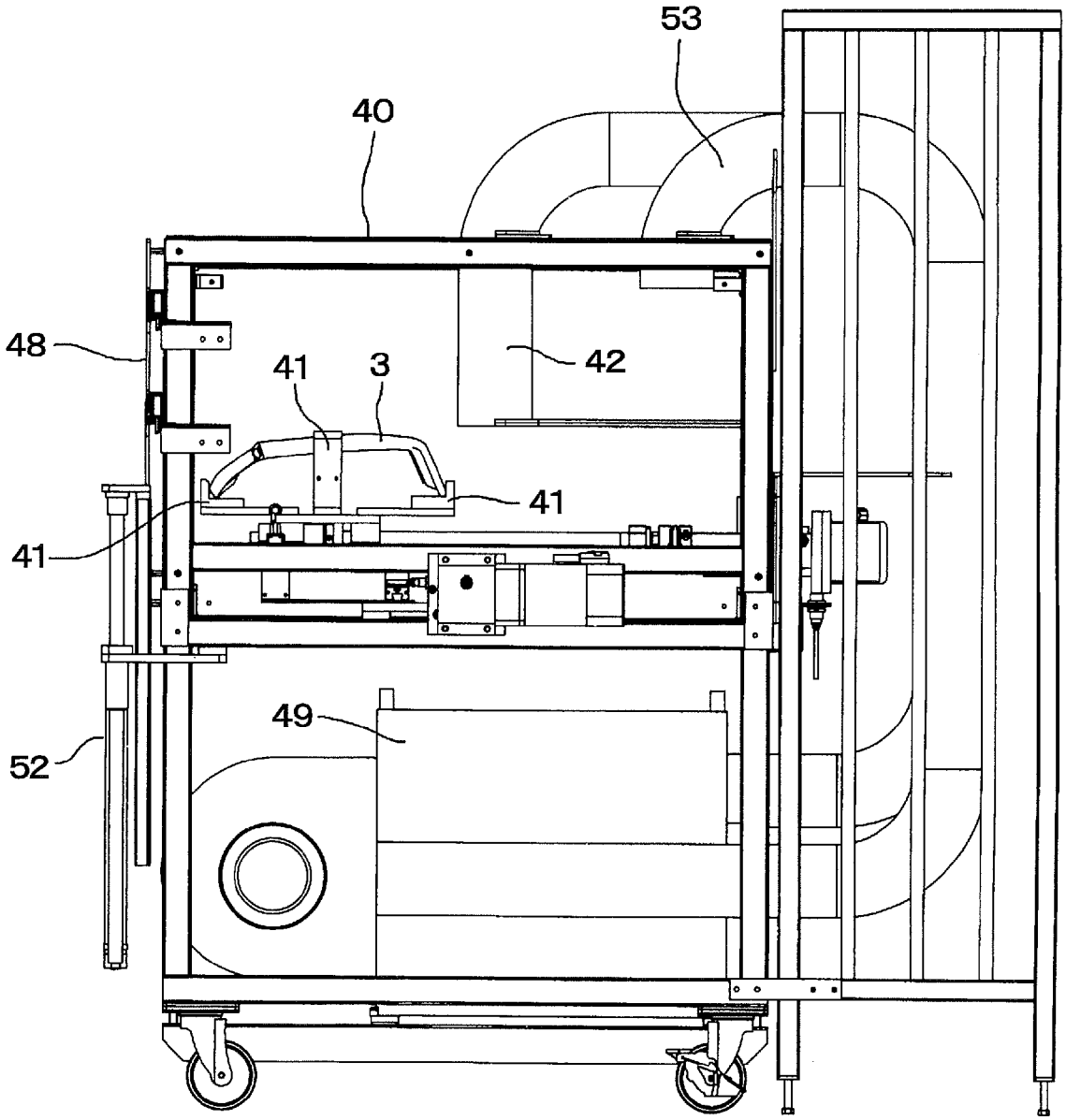
FIG. 15 is a side view of the apparatus and showing a heating chamber with heat insulating walls of a furnace body omitted.
Figure 16:
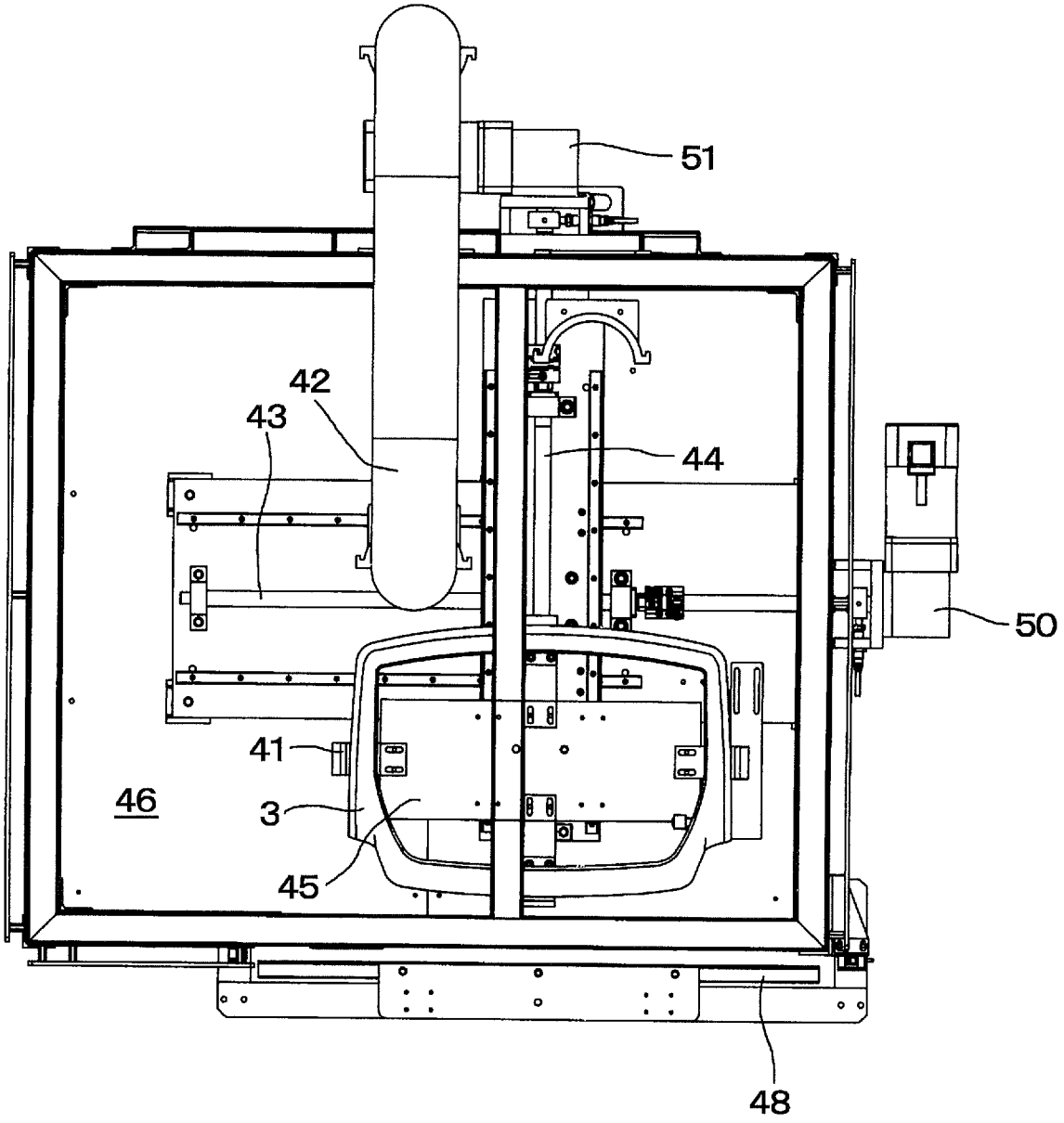
FIG. 16 is a plan view of the apparatus and showing the heating chamber with the heat insulating walls of the furnace body omitted.
Figure 17:
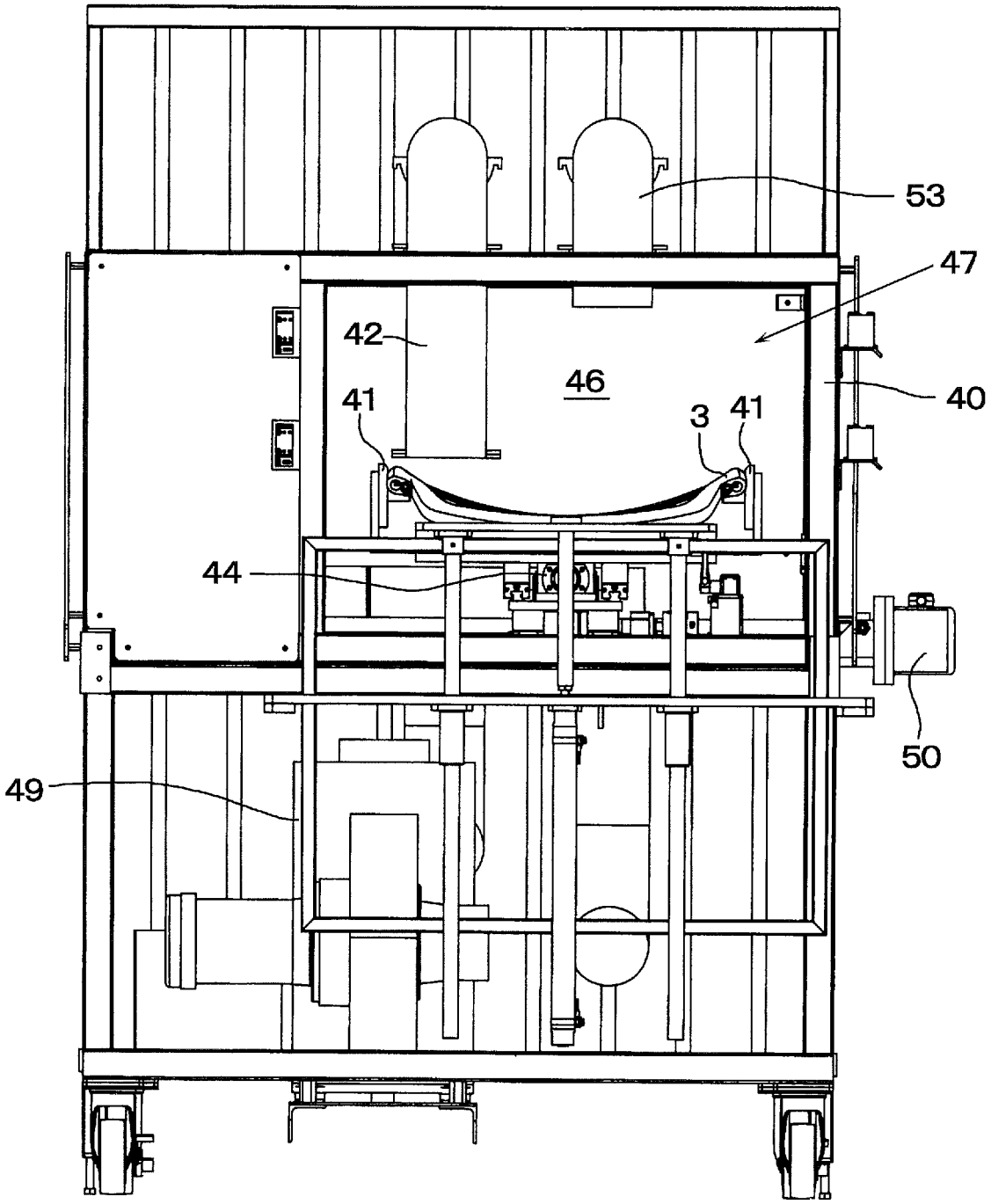
FIG. 17 is a front view of the apparatus and showing an inside of the heating chamber with a door omitted.

As a tension imparting apparatus for carrying out the heating treatment, it is convenient to use a tension imparting apparatus utilizing heating plates using heat derived from an electric heater as shown in FIGS. 12 and 13 for a seat having a membrane on an inner side of the frame member and mainly formed by a flat face. On the other hand, a membrane surrounded with a frame member 3 having a large curved face or a varied curved face is waving greatly and slack before heating. Therefore, if the heated plates are brought close to or pressed against the membrane to try to heat the membrane, local heating may cause irregular shrinkage to produce dark-colored portions and light-colored portions and therefore color irregularities may occur. Therefore, in a case of a back, a relatively large part of which is formed by a three-dimensional curved face, it is preferable to use a tension imparting apparatus of non-contact heating type for blowing thermal fluid such as hot air or superheated steam as shown in FIGS. 14 to 17.

First, the tension imparting apparatus using the heating plates shown in FIGS. 12 and 13 will be described. In the tension imparting apparatus, the body support structure 1 to which a membrane-like support frame 3 is restrained by receiving jig 31 is set between upper and lower paired heating plates 34 and 35 mounted to a base 30 to be lifted and lowered by cylinder devices 36 and 38 and lifting and lowering guide means 37 and 39, the heating plates 34 and 35 are brought close to the body support structure 1 to heat it. The receiving jig 31 for restraining the membrane-like support frame 3 is mounted to a feed table 32 for moving between an ejected position and a heated position of the body support structure 1 along a guide rail 33. The body support structure 1 is set on the receiving jig 31 on the feed table 32 in the ejected position in front of the heating plates 34 and 35, fed to the heated position between the upper and lower heating plates 34 and 35 and subjected to the heating treatment, caused to recede to the ejected position after the upper and lower heating plates 34 and 35 move away after the heating treatment, and taken out.

Here, preferably, the heating plates 34 and 35 have similar shapes smaller than an inner outline of the frame member 3 when seen from above and have heating faces substantially parallel to the membrane 2 stretched by heat shrinkage when seen from a side. For example, in the case of the seat 5 of the chair in the embodiment in FIG. 1 having the curved front portion 5*a* of the frame member 3 and the front edge zone 2*a* of the membrane 2 curved downward along the front portion 5*a*, heating faces are formed into rectangular shapes having four rounded corners when seen from above and are horizontal overall and have curved portions 34*a* and 35*a* corresponding to the curved face portion 2*a* of the front edge portion 5*a* of the seat 5 when seen from a side. Although it is not shown in the drawings, the heating plates 34 and 35 are provided with heaters in consideration of maintenance of uniform temperature distribution. In the embodiment, the heating plates are disposed both on a surface side and a back face side of the membrane 2 to heat and shrink opposite faces of the membrane 2 at the same time to thereby impart necessary tension to the membrane 2 in a short time while preventing a distortion and a warp. However, depending on circumstances, only one of the heating plates 34 and 35 may be disposed and a heat reflecting plate or the like may be disposed on the other side. The shapes of the heating plates 34 and 35 depend on an inner outline shape and a shape of the curved face of the frame member 3 and therefore are not restricted to the shapes shown in the drawings.

In order to heat the membrane 2 while maintaining a temperature applied to the frame member 3 at a lower temperature than the melting temperature of the frame member 3, a clearance L1 may be provided between the heating plates 34 and 35 and the frame member 3 to thereby make heat of the heating plates 34 and 35 less likely to be transferred to the frame member 3 or heat shield plates 40 protruding from a peripheral edge portion of the upper heating plate 34 toward the membrane 2 may be provided to prevent transfer of the heat of the heating plate 34 to the frame member 3 due to natural convection heat transfer. Especially, when the heating plate has the heat shield plates 40, escape of the heat from the peripheral edge of the heating plate 34 toward the frame member 3 is suppressed and entry of cold air from a periphery is also prevented by the heat shield plates 40 and therefore it is possible to uniformize the temperature of the heating plate 34 inside the surrounding heat shield plates 40 to thereby uniformly heat the membrane 2.

Figure 8B:
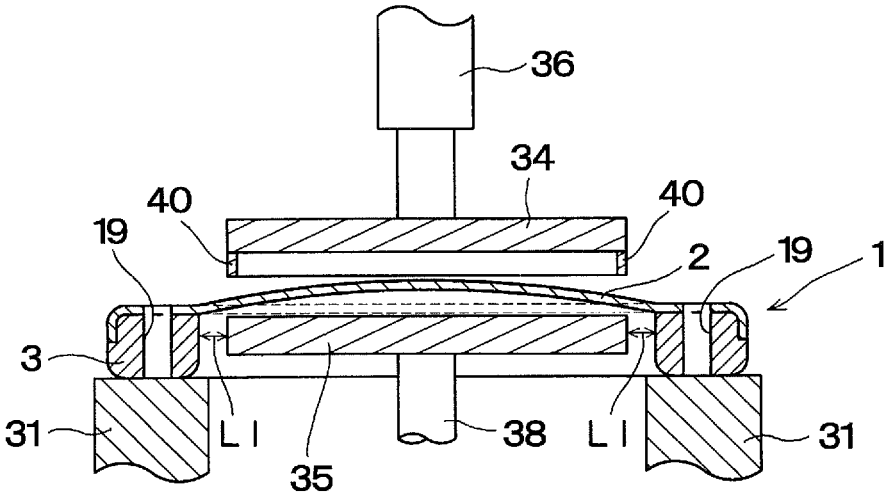
FIG. 8B is a schematic explanatory view showing a principle of heating treatment utilizing heating plates for the membrane and a relationship between the heating plates and the membrane at the start of heating.
Figure 8C:
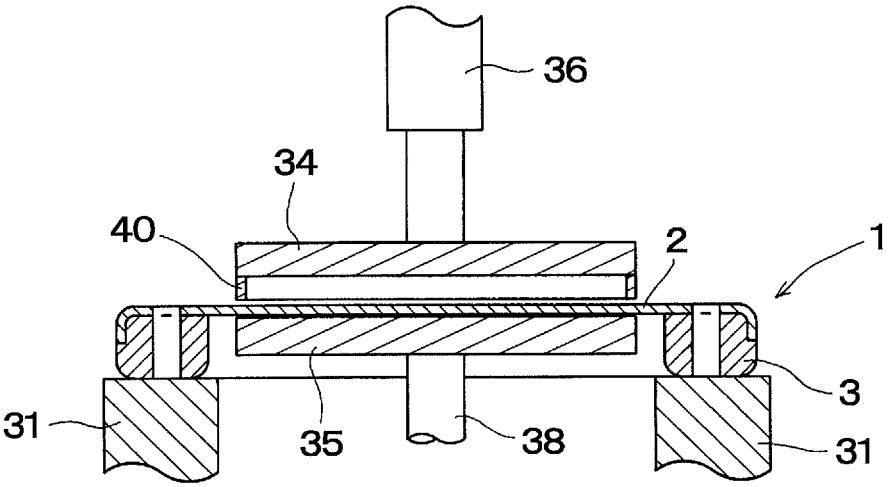
FIG. 8C is a schematic explanatory view showing a relationship between the heating plates and the membrane when the heating treatment is completed.

Heating of the membrane 2 is preferably carried out from a position away from the membrane 2 so as to prevent melting of the membrane 2 due to direct contact with the heating plates 34 and 35 or occurrence of irregularities of a mesh pattern due to irregular heating. Best preferably, intervals can be adjusted to follow shrinkage deformation of the membrane 2. In this case, it is possible to impart the necessary tension to the membrane 2 in a short time by minimizing distances between the heating plates 34 and 35 and the membrane 2. Therefore, in the embodiment, the cylinder devices 36 for expanding and contracting toward and away from the membrane 2 are used to support the heating plate on a protruding side of the slack of the membrane 2, that is, the upper heating plate 34 disposed on the surface side of the membrane 2 in the case shown in FIG. 8B, in such a manner as to be able to lift and lower the heating plate 34. Of course, when the membrane 2 slacks on the back face (inner) side, the lower heating plate 35 may be lifted and lowered by the cylinder 38. The cylinder device 36 supports the heating plate 34 in a position away from the membrane 2 so as not to come in contact with the membrane 2 at an initial stage of the heating at which the membrane 2 slacks as shown in FIG. 8B and expands so as to bring the heating plate 34 close to the membrane 2 as shown in FIG. 8C as the heating proceeds and the slack in the membrane 2 is removed. For example, in the embodiment, the upper heating plate 34 is moved so that a distance between a face formed by the membrane 2 after the heat shrinkage and the heating face of the upper heating plate 34 changes from 40 mm to 30 mm and to 15 mm in stages. Although both of the upper heating plate 34 and the lower heating plate 35 are lifted and lowered in the apparatus in the embodiment shown in FIGS. 12 and 13, the invention is not restricted to it. Only the upper heating plate 34 may be moved as shown in the example in FIG. 8B or only the lower heating plate 35 may be moved. Although it is common practice to automatically control movements of the heating plates 34 and 35, that is, expansion and contraction of the cylinders 36 and 38 by utilizing various sensors such as a temperature sensor and a distance sensor, a timer, and the like, it is also possible to carry out the control by means of relay sequence control or manual control.

In the case of the embodiment employing the mesh formed by the textile of the polyester yarn 12 and the elastomer polyester yarn 13 as the membrane 2, the temperature and heating time at and for which the membrane 2 is heated are controlled in ranges shown below as examples. In other words, the temperature in the case of the heating plates 34 and 35 such as the lower heating plate 35 which substantially comes in contact with the membrane 2 is preferably in a range of about 120 to 250° C. and best preferably in a range of about 180 to 190° C., for example. The temperature in the case of the heating plates 34 and 35 such as the upper heating plate 34 which does not come in contact with the membrane 2 is preferably in a range of about 180 to 300° C. and best preferably in a range of about 190 to 240° C., for example. The heating time is preferably about 40 to 120 seconds, for example. A temperature of the frame member 3 during heating of the membrane 2 is preferably ordinary temperature or a temperature close to the ordinary temperature, a difference in temperature between the membrane 2 and the frame member 3 during heating is preferably about 5 to 200° C. and best preferably 150° C. or higher. However, optimum heating conditions can change depending on selected material or the like of the membrane 2 and are not necessarily restricted to the above-described conditions.

Next, FIGS. 14 to 17 show an example of the tension imparting apparatus utilizing thermal fluid. The tension imparting apparatus includes a receiving jig 41 for restraining a membrane-like support frame 3 of a body support structure 1, a duct 42 for blowing the thermal fluid toward a spot of the membrane 2, an XY table 45 having axial feed mechanisms 43 and 44 mounted with the receiving jig 41 or the duct 42 to feed it in a direction of an x-axis or a y-axis, a workpiece entrance 47 which defines a heating chamber 46 for housing the receiving jig 41, the duct 42, and the XY table 45, through which the body support structure 1 is carried in and out, and which can be opened and closed, a furnace body 40 having an exhaust opening (duct) 53 for exhausting the thermal fluid, after heating the membrane 2, outside the heating chamber, and a thermal fluid generating source 49 for generating the thermal fluid and supplying it into the heating chamber 46 through the duct 42. The thermal fluid generated in the thermal fluid generating source 49 is blown downward from the duct 42 fixed to a ceiling of the heating chamber 46 and the thermal fluid in the furnace is exhausted outside the furnace body 40 through the exhaust duct 53 disposed in a corner of the heating chamber 46. Incidentally, it is preferable to employ hot air or superheated steam as the thermal fluid and, best preferably, the hot air is used. The furnace body 40 is covered with a heat insulating cover.

In the apparatus in the embodiment which employs the hot air as the thermal fluid, the hot air is supplied while its temperature at an outlet of the thermal fluid generating device 49 is adjusted to about 220° C. and blown out of the duct 42 at the temperature which has dropped to about 190° C. to 200° C. The duct 42 is fixed to be positioned at a center of the furnace body 40, that is, over an origin of coordinate axes of the XY table 45 in the heating chamber 46 and a blown position is moved with respect to the membrane-like support frame 3 of the body support structure 1 positioned by the receiving jig 41. In this apparatus, the hot air used for heating of the membrane is exhausted outside the furnace through the exhaust duct 53 by forced draft. The heating by the hot air is at about 200° C. and for about 45 seconds and an interval between the duct 42 blowing out the hot air and the frame member 3 is about 30 mm when they are the closest to each other.

The XY table 45 has the receiving jig 41 for retaining the frame member 3 in the three-dimensional shape for positioning it and feed screw mechanisms 43 and 44 in two directions orthogonal to each other provide relative movements of the duct 42 for blowing out the hot air and the membrane 2 in the front-back/vertical direction (y-axis direction) and the left-right direction (x-axis direction). Incidentally, threaded shafts of the respective feed screw mechanisms 43 and 44 are respectively driven for rotation by drive motors 50 and 51 disposed outside the furnace body 40. The receiving jig 41 for retaining the frame member 3 for positioning it is formed by four lugs for grasping the frame member 3 at intervals of 90° from a periphery, for example, so that the frame member 3 can be easily mounted at a single touch.

The workpiece entrance 47 for carrying in and out the body support structure 1 is formed on a front side of the furnace body 40 and can be opened and closed by a door 48 which can be driven to be lifted and lowered by an air cylinder 52 provided on a front side of the workpiece entrance 47. Normally, opening and closing of the door 48 and blowing of the hot air are controlled to interlock with each other. The hot air is blown out after the body support structure 1 is set on the receiving jig 41 and the door 48 is closed and continues to be blown out for a predetermined heating tact time and the blowing out of the hot air is stopped or an amount of blowing is reduced before the door 48 is opened.

Figure 18:
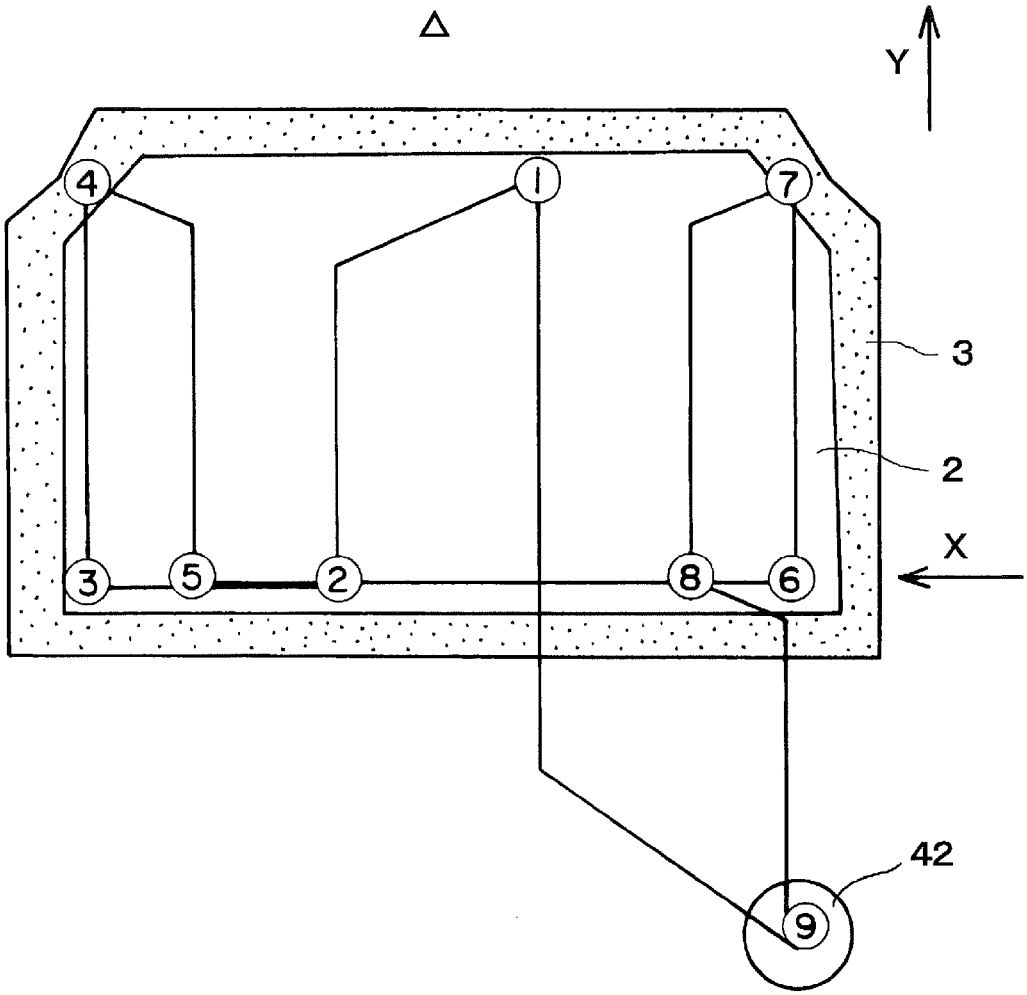
FIG. 18 is a schematic explanatory view a locus of relative movement of a duct for blowing the thermal fluid and the membrane in the apparatus.

Here, the relative movements of the membrane 2 and the duct 42 are achieved by control of the XY table 45 so that the duct 42 starts from a center of the membrane (not shown) and relatively moves from the center to one end and to the other end of the membrane while alternately repeating a movement in the front-back/vertical direction between ends of the membrane and a traverse in the left-right direction as shown in FIG. 18. To put it more concretely, by relatively moving a position for blowing out the hot air, that is, a position of the duct 42 in an order shown with encircled numbers 1 to 9 in FIG. 18, the entire area of the membrane on the inner side of the frame member 3 is heated while the entire membrane is shrunk and the tension is imparted to the membrane. In FIG. 18, a side shown with a mark Δ is a side of an operator, that is, a side of the door 48.

According to the tension imparting apparatus formed as described above, it is possible to start the heating treatment by only opening the door 48 of the workpiece entrance 47, setting the body support structure 1 on the receiving jig 41 in the heating chamber 46, and closing the door 48. The heating treatment is carried out for the entire area of the membrane by relatively moving the blowing position of the hot air or the superheated steam blown out toward the spot from the center to the periphery while alternately repeating the movement in the front-back/vertical direction and the left-right direction in the state in which the membrane-like support frame 3 of the body support structure 1 is restrained. As a result, the membrane 2 fixed in a slack state to the frame member 3 having the three-dimensional shape is stretched tightly to form the three-dimensional body support face 4 along the shape of the frame member due to a difference in tension between the front-back/vertical direction and the left-right direction of the membrane caused by heat shrinkage.

The heating treatment does not necessarily have to be carried out for the body support structure 1 mounted to and restrained by the receiving jig 41 as in the above-described tension imparting apparatus. If the melting temperature of the frame member 3 is sufficiently higher than the temperature necessary for the heat shrinkage of the membrane 2, the body support structure 1 after taken out of the die and before imparting of the tension may be caused to move through a continuous or batch heating furnace such as a far-infrared furnace, the membrane 2 may be heated by an atmosphere in the furnace while a temperature of the frame member 3 is maintained at a lower temperature than the melting temperature of the frame member 3, and the membrane 2 may be shrunk with heat so that the tension for exerting elasticity required of the body support structure 1 is imparted to the membrane 2. Incidentally, the temperature in the furnace is in a range of about 120 to 250° C., for example, and best preferably in a range of about 180 to 190° C., for example, and a heating time is about 40 to 120 seconds, for example. Although it is not shown in the drawings, if a heat insulating case for covering only the frame member 3 is used and the body support structure 1 with only the membrane 2 exposed is subjected to the heating treatment in the heating furnace, it is possible to heat only the membrane 2 while restraining the frame member 3 and insulating the frame member 3 from heat. Furthermore, a cooling channel through which cooling water flows may be formed in the heat insulating case to proactively lower temperature around the frame member 3.

Next, for the seat of the chair shown in FIGS. 1 to 4, evaluations of materials were performed by using the tension imparting apparatus shown in FIGS. 12 and 13. A heating time not longer than 30 seconds at a heating plate temperature of 200° C. in the tension imparting treatment of the membrane 2 was not preferable, because irregularities occurred. A heating time of about 45 seconds was suitable. A long heating time over 45 seconds worsened productivity. With regard to tension of the stretched mesh, a sinking amount when a weight of 2 kg is placed on the mesh needs to be not greater than 12 mm. When the heating was carried out at 200° C. for 45 seconds, the sinking amount was in a range of about 6 to 7 mm. It was found that the heating plate temperature lower than 220° C. and preferably in a range of 200° C. to 190° C. was suitable, because elastic yarn in an area of the membrane strongly pressed by the heating plates for the heating time of 35 seconds discolored if the heating plate temperature was 220° C.

Evaluation tests of mesh shrinkage ratio were conducted by using the meshes used for the seat of the chair shown in FIG. 1 as evaluated samples. Here, an evaluated sample A was formed by a textile woven into a mesh by using warp 10 and weft 11 formed by two strands obtained by twisting pieces of 300-denier polyester yarn. Moreover, monofilaments of 1850-denier elastomer polyester yarn were disposed and woven in a lattice shape in both of a front-back direction and a left-right direction so as to pass through stitches 9 of the mesh woven by using the warp 10 and the weft 11. An evaluated sample B was used for the seat of the chair shown in FIG. 1 and was formed by a textile woven into a mesh by using warp 10 formed by five strands 12 obtained by twisting pieces of 300-denier polyester yarn and weft 11 formed by two strands 12 of the same polyester yarn and three monofilaments of 1850-denier elastomer polyester yarn 13 and stitches of the mesh were closely disposed in a front edge portion 2*a*.

Seats using the evaluated samples A and B as membranes were produced and the membranes were stretched by carrying out heating at a heating plate temperature of 200° C. for 45 seconds by using the apparatus in FIGS. 12 and 13. As a result, in the evaluated sample A, curvature of a curved face of a front edge portion gradually changed as it extended away from opposite sides of the frame member and became the most recessed and warped curved face at a center in the left-right direction. On the other hand, in the evaluated sample B, a curved face portion of a front edge portion was not recessed at all in the left-right direction and curvature of the curved face was the same near a center in the left-right direction away from opposite sides of the frame member, not to mention at opposite sides of the frame member.

The evaluation tests of mesh shrinkage ratio of the evaluated samples A and B were performed. The evaluation tests were performed by forming three sample pieces each of which was a mesh of the front edge portion 2*a* of the seat and had a size of about 100×100 mm and blowing hot air of 190° C. on the sample pieces for 110 seconds. Then, shrinkage ratios were obtained before and after blowing of the hot air. Results of the evaluation tests are shown in Table 1.

TABLE 1

| | Evaluated sample A | | Evaluated sample B | |
|---|---|---|---|---|
| | Front-back | Left-right | Front-back | Left-right |
| | Dimension before test (mm) | | Dimension before test (mm) | |
| Sample 1 | 101 | 101 | 101.0 | 101.0 |
| Sample 2 | 100 | 101 | 101.0 | 100.5 |
| Sample 3 | 101 | 101 | 102.0 | 102.0 |

TABLE 1-continued

| | Evaluated sample A | | Evaluated sample B | |
|---|---|---|---|---|
| | Front-back | Left-right | Front-back | Left-right |
| | Dimension after test (mm) | | Dimension after test (mm) | |
| Sample 1 | 94 | 93 | 96.0 | 88.5 |
| Sample 2 | 95 | 95 | 96.0 | 88.0 |
| Sample 3 | 94 | 93 | 96.5 | 88.5 |
| | Shrinkage ratio (%) | | Shrinkage ratio (%) | |
| Sample 1 | 6.93 | 7.92 | 4.95 | 12.38 |
| Sample 2 | 5.00 | 5.94 | 4.95 | 12.44 |
| Sample 3 | 6.93 | 7.92 | 5.39 | 13.24 |
| Average | 6.29 | 7.26 | 5.10 | 12.68 |
| Average of front-back and left-right | 6.77 | | 8.89 | |

From these results, in the evaluated sample A, a percentage of the shrinkage ratio in the front-back direction to the shrinkage ratio in the left-right direction was about 87%, that is, the shrinkage ratio in the front-back direction and the shrinkage ratio in the left-right direction were substantially the same.

In the curved portion of the front zone 5*a* of the seat 5, while the yarn in the left-right direction linearly connects sides 3*a* of the frame member 3 and an amount of displacement in the depth direction (z-axis direction) of the yarn in the left-right direction was zero (see FIG. 4), an amount of displacement of the yarn in the front-back direction in the depth direction (z-axis direction) was large (see FIG. 3). If there were no yarn in the left-right direction, the yarn in the front-back direction would be stretched linearly and diagonally along a shortest distance between opposite ends. Therefore, in the evaluated sample A in which the shrinkage ratios in the front-back direction and the left-right direction were substantially the same, the yarn in the front-back direction was restricted by the tension of the yarn in the left-right direction and stretched along arrangement of the pieces of the yarn in the left-right direction to form a curved line corresponding to a curve of the front zone 5*a* of the frame member 3 near the sides 3*a* of the frame member 3. Near the center in the left-right direction, the membrane was affected the most by the tension of the yarn in the front-back direction to substantially form a diagonal straight line connecting opposite ends in the front-back direction. As a result, it was found that, as the curved face of the front edge zone 2*a* of the membrane 2, the membrane 2 formed curved faces corresponding to the curved portion 5*a* near the sides 3*a* of the frame member 3, a radius of curvature gradually increased as compared with that of peripheries as the membrane 2 extended away from the sides 3*a* to form a substantially gentle slope, and the most recessed face warped as a whole was formed near the center in the left-right direction.

On the other hand, in the evaluated sample B in which the curved face having the same curvature was formed between one side 3*a* and the other side 3*a*, the shrinkage ratio in the front-back direction and the shrinkage ratio in the left-right direction were totally different and a percentage of the shrinkage ratio in the front-back direction to the shrinkage ratio in the left-right direction was about 40%. As a result, the yarn in the front-back direction was stretched along the face formed by the pieces of the yarn in the left-right direction and stretched between the sides 3*a* of the frame member 3 and therefore curvature of the curved face of the front edge zone 2*a* of the membrane 2 was the same near a center in the left-right direction away from the sides 3*a*, not to mention at portions near the sides 3*a* of the frame member 3. This means that, if the heat shrinkage ratio in the direction with a smaller amount of displacement in the depth direction (z-axis direction) is higher than the heat shrinkage ratio in the direction with a larger amount of displacement in the depth direction, a shape in the direction with the smaller amount of displacement in the depth direction becomes dominant.

Consequently, the greater the difference in the shrinkage ratio between the front-back direction and the left-right direction of the membrane 2, the more similar body support face 4 to the shape of the side in the y-axis direction or the x-axis direction of the frame member 3 can be formed. In other words, it was found that the shape of the body support face 4 could be made similar to a more ideal shape by making the shape of the frame member 3 similar to the intended three-dimensional shape. However, optimum values of the shrinkage ratios required of the mesh material may change depending on the shape of the chair and elastic force required of the face formed by the membrane 2 and therefore are not necessarily restricted to those in the above examples.

Although the above-described embodiments are examples of preferred embodiments of the invention, the invention is not restricted to them and can be changed in various ways without departing from the gist of the invention. For example, although the invention has been described while taking the body support structures formed mainly as the seat and the back as examples in the above-described embodiments, the body support structure is not especially restricted to them and it is of course possible to apply it to a head rest or an armrest. Moreover, the invention can be applied to chairs in general, for example, chairs for general purposes, office chairs, chairs for operation, chairs for nursing care, and the like. Although the body support structure 1 can be used as it is as the seat, the backrest, or the like of the chair according to the invention, a surface skin member may be attached to the body support structure 1 or cushion may be used together with the body support structure 1 depending on circumstances.

REFERENCE SIGNS LIST

1 body support structure
2 membrane
2*a* curved face near front edge portion of membrane
3 frame member
4 body support face
5 seat
5*a* curved portion near front edge portion of frame member
6 back
8 chair
10 warp
11 weft
12 polyester yarn (strand)
13 elastomer yarn (monofilament)
34, 35 heating plates
42 duct for jetting thermal fluid

The invention claimed is:

1. A chair including a body support structure having a body support face which spreads along X-axis direction and Y-axis direction orthogonal to each other and is formed by a membrane;

wherein the body support structure includes a frame member and the membrane;

wherein the frame member is formed into a curved shape by curving in the Z-axis direction orthogonal to the X-axis direction and the Y-axis direction;

the membrane has a difference between the heat shrinkage ratio in the X-axis direction and the heat shrinkage ratio in the Y-axis direction;

the membrane which has a peripheral edge portion fixed to the frame member, under tension lower than the tension required of the body support face is shrinkable when heated;

the tension required of the body support face is imparted to the membrane by heat shrinkage of the membrane;

the membrane is stretched along the shape of the frame member and into the curved shape by curving in the Z-axis direction due to a difference between tension in the X-axis direction and tension in the Y-axis direction caused by the heat shrinkage;

wherein the frame member has a difference between an amount of displacement in the Z-axis direction along the X-axis direction and an amount of displacement in the Z-axis direction along the Y-axis direction;

the membrane has the higher heat shrinkage ratio in the direction with a smaller amount of displacement in the Z-axis direction out of the X-axis direction and the Y-axis direction than in the direction with a larger amount of displacement in the Z-axis direction out of the X-axis direction and the Y-axis direction;

the entire membrane shrinks along the shape of the frame member due to the difference between the tension in the X-axis direction and the tension in the Y-axis direction caused by the heat shrinkage; and the membrane is stretched into the curved shape by curving in the Z-axis direction.

2. The chair according to claim 1, wherein the membrane is a textile membrane woven by using heat shrinkable warp and weft;

wherein the textile membrane has a difference between the shrinkage ratio in the X-axis direction and shrinkage ratio in the Y-axis direction which is obtained by weaving in elastomer yarn having a higher heat shrinkage ratio than the heat shrinkable yarn forming the textile membrane.

3. The chair according to claim 2, wherein the textile membrane includes the elastomer yarn which is woven in as one of the warp and the weft.

4. The chair according to claim 2, wherein the elastomer yarn is woven in as the warp and the weft.

5. The chair according to claim 2, wherein the difference between the heat shrinkage ratio in the X-axis direction and the heat shrinkage ratio in the Y-axis direction of the textile membrane is obtained by weaving in the elastomer yarn along one of the warp and the weft besides the warp and the weft forming the textile membrane.

6. The chair according to claim 2, wherein the difference between the heat shrinkage ratio in the X-axis direction and the heat shrinkage ratio in the Y-axis direction of the textile membrane is obtained by weaving in the elastomer yarn along both of the warp and the weft besides the warp and the weft forming the textile membrane.

7. The chair according to claim 1, wherein the membrane is a knit membrane knitted by using heat shrinkable yarn;

wherein the knit membrane has a difference between shrinkage ratio in the X-axis direction and shrinkage ratio in the Y-axis direction which is obtained by inserting and knitting elastomer yarn, having a higher heat shrinkage ratio than the heat shrinkable yarn forming the knit membrane, in a course direction.

8. The chair according to claim 2, wherein the textile membrane is woven by using the warp and the weft having the same heat shrinkage ratios at the same heating temperature.

9. The chair according to claim 2, wherein the textile membrane is woven by using the warp and the weft made of at least two kinds of elastic materials having the different heat shrinkage ratios at the same heating temperature.

10. The chair according to claim 2, wherein density of arrangement of the elastomer yarn varies in different parts of the body support structure.

11. The chair according to claim 10, wherein the body support structure is a seat and more pieces of elastomer yarn are disposed in a curved shape portion on a front edge side of the membrane than in the other area.

12. The chair according to claim 10, wherein the body support structure is a back and more pieces of elastomer yarn are disposed in a curved shape portion of a lumbar support portion of the membrane than in the other area.

13. The chair according to claim 2, wherein the textile membrane is a mesh-like textile membrane and stitches in a peripheral edge portion including a vicinity of a boundary between the frame member and the textile membrane are finer than stitches in an inner portion of the peripheral edge portion.

14. The chair according to claim 7, wherein the knit membrane is a mesh-like knit membrane and stitches in a peripheral edge portion including a vicinity of a boundary between the frame member and the knit membrane are finer than stitches in an inner portion of the peripheral edge portion.

15. The chair according to claim 1, wherein the tension is imparted to the membrane by blowing thermal fluid to heat the membrane.

16. The chair including the membrane according to claim 1, wherein the membrane is a textile membrane woven by using the warp and the weft made of at least two kinds of elastic materials having the different heat shrinkage ratios at the same heating temperature.

17. The chair according to claim 1, wherein the membrane is a mesh-like textile membrane and stitches in a peripheral edge portion including a vicinity of a boundary between the frame member and the textile membrane are finer than stitches in an inner portion of the peripheral edge portion.

18. The chair according to claim 2, wherein the tension is imparted to the membrane by blowing thermal fluid to heat the membrane.

* * * * *